US007535865B2

(12) United States Patent
Aiken, II et al.

(10) Patent No.: US 7,535,865 B2
(45) Date of Patent: May 19, 2009

(54) SYSTEM AND METHOD FOR WIRELESS REMOTE CONTROL OF LOCOMOTIVES

(75) Inventors: Robert C. Aiken, II, Greenville, PA (US); Richard Evans, Masury, OH (US); Carl L. Verholek, Sharpsville, PA (US); William Ducklin, Hermitage, PA (US); Steve McDonald, Hubbard, OH (US); Dana Conner, Valencia, PA (US); Scott Lordo, Hermitage, PA (US); Curt Bellotti, Transfer, PA (US); Robert Rader, Greenville, PA (US)

(73) Assignee: Cattron-Theimeg, Inc., Sharpsville, PA (US)

( * ) Notice: Subject to any disclaimer, the term of this patent is extended or adjusted under 35 U.S.C. 154(b) by 1219 days.

(21) Appl. No.: 10/632,525

(22) Filed: Jul. 31, 2003

(65) Prior Publication Data

US 2004/0114631 A1 Jun. 17, 2004

Related U.S. Application Data

(63) Continuation-in-part of application No. 10/210,777, filed on Jul. 31, 2002.

(51) Int. Cl.
*H04W 4/00* (2009.01)

(52) U.S. Cl. ..... 370/328; 370/337; 370/346; 370/349; 340/992; 340/993

(58) Field of Classification Search ..... 370/328, 370/337, 346, 349; 340/992, 993

See application file for complete search history.

(56) References Cited

U.S. PATENT DOCUMENTS 2,769,601 A 11/1956 Hagopian et al.

(Continued)

FOREIGN PATENT DOCUMENTS

BE 870148 9/1978

(Continued)

OTHER PUBLICATIONS

Simmons-Boardman Publishing Corporation, "FCC Grants Petition on Tone Modulation." Railway System Controls, vol. 3, n. 7, pp. 11-12, 1972.

(Continued)

*Primary Examiner*—Ricky Ngo
*Assistant Examiner*—Phuongchau B Nguyen
(74) *Attorney, Agent, or Firm*—Thorp Reed & Armstrong, LLP

(57) ABSTRACT

A system and method for remotely controlling an increased number of subsystems having an onboard locomotive control unit (LCU) and two associated operator control units (OCUs) on a single wireless channel. A time slot is assigned to each subsystem for making two-way transmissions to control the locomotive. A signal from an external timing source synchronizes each subsystem to minimize interference between transmissions from different subsystems. Time slots are assigned manually or automatically over a wireless network or by the LCU after monitoring the channel. The LCU automatically selects the direct or repeater transmission path depending upon whether or not it receives polling message responses from its associated OCUs. A GPS receiver in each subsystem receives the synchronization signal and provides geographic positioning data so the LCU can determine when to execute predefined, position-based commands. The secondary OCU may be turned off and rejoined to the subsystem without ceasing operation.

53 Claims, 10 Drawing Sheets

U.S. PATENT DOCUMENTS 2,961,640 A 11/1960 von Behren
3,293,549 A 12/1966 Patterson
3,304,501 A 2/1967 Ruthenberg
3,530,434 A 9/1970 Stites et al.
3,601,605 A 8/1971 Elder
3,696,758 A 10/1972 Godinez, Jr.
3,811,112 A 5/1974 Hoven et al.
3,944,723 A * 3/1976 Fong ..... 340/825.02
4,015,082 A 3/1977 Matty et al.
4,056,286 A 11/1977 Burkett
4,069,402 A * 1/1978 Mantovani et al. ..... 370/247
4,087,066 A 5/1978 Bähker
4,133,504 A 1/1979 Dobler et al.
4,179,624 A 12/1979 Shindo et al.
4,179,739 A 12/1979 Virnot
4,190,220 A 2/1980 Hahn et al.
4,301,533 A * 11/1981 Acampora et al. ..... 370/318
4,335,381 A 6/1982 Palmer
4,359,733 A * 11/1982 O'Neill ..... 342/36
4,370,614 A 1/1983 Kawada et al.
4,380,050 A 4/1983 Tanner
4,410,983 A 10/1983 Cope
4,445,175 A 4/1984 Cohen
4,456,997 A 6/1984 Spitza
4,464,659 A 8/1984 Bergqvist
4,519,002 A 5/1985 Amano
4,525,011 A 6/1985 Wilson
4,614,274 A 9/1986 LaValle et al.
4,713,809 A * 12/1987 Mizota ..... 370/315
4,768,740 A 9/1988 Corrie
4,775,116 A 10/1988 Klein
4,835,537 A 5/1989 Manion
4,854,529 A 8/1989 Osada et al.
4,901,307 A * 2/1990 Gilhousen et al. ..... 370/320
4,950,964 A 8/1990 Evans
4,955,304 A 9/1990 Spenk et al.
5,005,014 A 4/1991 Jasinski
5,012,749 A 5/1991 Passage, Jr.
5,029,532 A 7/1991 Snead
5,039,038 A * 8/1991 Nichols et al. ..... 246/3
5,109,543 A 4/1992 Dissosway et al.
5,129,096 A * 7/1992 Burns ..... 455/18
5,222,024 A 6/1993 Orita et al.
5,225,842 A 7/1993 Brown et al.
5,297,144 A * 3/1994 Gilbert et al. ..... 370/346
5,309,351 A * 5/1994 McCain et al. ..... 340/825.72
5,351,194 A 9/1994 Ross et al.
5,353,009 A * 10/1994 Marsh et al. ..... 340/505
5,355,511 A 10/1994 Hatano et al.
5,376,869 A 12/1994 Konrad
5,392,450 A * 2/1995 Nossen ..... 455/12.1
5,412,572 A 5/1995 Root et al.
5,474,267 A 12/1995 Kubota et al.
5,479,156 A 12/1995 Jones
5,511,749 A 4/1996 Horst et al.
5,526,357 A * 6/1996 Jandrell ..... 370/346
5,537,414 A 7/1996 Takiyasu et al.
5,548,802 A * 8/1996 Barnes et al. ..... 455/15
5,553,069 A * 9/1996 Ueno et al. ..... 370/315
5,648,955 A 7/1997 Jensen et al.
5,685,507 A 11/1997 Horst et al.
5,689,502 A 11/1997 Scott
5,691,980 A * 11/1997 Welles et al. ..... 370/316
5,696,903 A 12/1997 Mahany
5,714,948 A 2/1998 Farmakis et al.
5,732,076 A 3/1998 Ketseoglou et al.
5,737,330 A 4/1998 Fulthorp et al.
5,847,663 A * 12/1998 Chasek ..... 340/988
5,847,679 A 12/1998 Yee et al.
6,088,590 A 7/2000 Anderson et al.
6,129,449 A * 10/2000 McCain et al. ..... 345/173
6,243,372 B1 6/2001 Petch et al.
6,314,366 B1 11/2001 Farmakis et al.
6,370,381 B1 4/2002 Minnick et al.
6,487,179 B1 * 11/2002 Leung ..... 370/286
6,496,775 B2 12/2002 McDonald, Jr. et al.
6,570,858 B1 * 5/2003 Emmons et al. ..... 370/321
6,658,336 B2 12/2003 Browne et al.
6,865,166 B1 * 3/2005 Wilcoxson et al. ..... 370/330
7,069,122 B1 * 6/2006 Higgs ..... 701/19
7,120,428 B2 10/2006 Higgs
2002/0070891 A1 * 6/2002 Huston et al. ..... 342/357.09
2002/0089434 A1 7/2002 Ghazarian
2003/0011879 A1 * 1/2003 Kasahara et al. ..... 359/341.4
2003/0035519 A1 * 2/2003 Warmus ..... 379/88.17
2004/0117073 A1 * 6/2004 Horst ..... 701/2
2004/0120305 A1 * 6/2004 Aiken et al. ..... 370/347
2004/0249571 A1 12/2004 Blesener et al.
2006/0215605 A1 * 9/2006 Srikrishna et al. ..... 370/329
2007/0021915 A1 * 1/2007 Breed et al. ..... 701/301

FOREIGN PATENT DOCUMENTS

BE 870149 9/1978
BE 894768 10/1982
BE 894769 10/1982
BE 894853 10/1982
DE 2354067 10/1973
DE 2449660 4/1976
DE 2756613 6/1979
DE 3702527 8/1988
EP 0326630 8/1989
FR 2302653 9/1976
GB 2192516 1/1988
WO 00/58142 10/2000

OTHER PUBLICATIONS

Escher, R. "Remote Control and Transmission of Data by Radio; Funkfernsteuerung mit Datenuebertragung," Technische Mitteilungen AEG-Telefunken, v. 64, n. 4, pp. 129-131, 1974 (Abstract translation only).

Vandervort, T.L. "PCM Used for Remote Controls." Railway System Controls v. 2, n. 8, p. 20-25, Aug. 1971.

McElhenny, S.W. et al. "Trends in Rail Transportation." 1968 IEEE International Convention, p. 39 (1968).

Fischer, K. "Radio-Telephone for Railroads and Local Traffic." Glasers Ann. v. 94, n. 12, p. 387-393, Dec. 1970 (Abstract translation only).

Nagase, K. "Automation of Locomotive Shunting Operations at Musashino Marshalling Yard." Japanese Railway Engineering v. 17, n. 1 pp. 19-21 (1977).

Grolms, R. et al. "Radio Remote Control of the Hump Locomotives at the Munich (North) Marshalling Yard." Signal and Draht v. 82, n. 12, p. 231-235 (1990) (Article translation included).

"CN Rail's Beltpack Single Man Hump Operation." CN Rail LCS Presentation Sep. 1992.

Aiken II, R.D. "Radio Crane Controls: Factors Involved in Selection and Installation." Cattron Incorporated Brochure, 1985.

"Remote Control of Slave Locomotives." The Railway Gazette, Sep. 1, 1968.

König, H. "Variation der Abdrückgeschwindigkeit bei quasikontinuierlicher Geschwindigkeitssteuerung im Zentralverschiebebahnhoff Wien." RT + GT—Rangiertechnik und Glolsanschlusstechnik 49, pp. 3-6 (1989).

ÖBB Journal Die Fachzeitschrift der Österreichischen Bundesbalmen pp. 28, 32-34, Jan.-Feb. 1987.

National Safety Council, "Radio-Remote-Control Locomotives." National Safety Council Data Sheet 1-707-85 (1985).

"Railways; SMET Automatic Control System for Multiple Trains" BBC Summary of World Broadcasts, Aug. 16, 1986.

Krauss-Maffei Verkehrstechnik, "K-MEMO für Lok G850BB u. G700C ARBED Funktionsbeschreibung" Produktbereich Fahrzeugelektronik Jan. 18, 1991.

Krauss-Maffei Verkehrstechnik, "K-MICRO: Anti-wheelship and anti-wheelskid device, General Description" Product Line Vehicle Electronics, Aug. 27, 1991.

"Locomotive Control System LCS-Beltpack" CN Rail LCS BP Presentation, Sep. 1991.

Massie, Herbert L. "Channel Utilization by Remote Locomotive Control Systems Using Digital Transmission." 1976 IEEE Convention, p. 134-7 (1976).

Schonenberger, Albert "Speed Control for Shunters." Krauss Maffei Journal, Jun. 1988.

Theimeg USA, Inc., "Canadian National Contract Proposal," p. 15-16, Feb. 15, 1991.

* cited by examiner

SYSTEM AND METHOD FOR WIRELESS REMOTE CONTROL OF LOCOMOTIVES

This application is a continuation-in-part of U.S. application Ser. No. 10/210,777, filed on Jul. 31, 2002.

FIELD OF THE INVENTION

The present invention relates generally to wireless remote controlled mobile devices and more particularly to a system and method for the wireless remote control of locomotives.

BACKGROUND OF THE INVENTION

Current systems and methods used for the wireless/radio remote control of locomotives, particularly in switching yards, typically employ a microprocessor based controller mounted onboard the locomotive and one or more one-way portable radio transmitters or operator control units associated with the controller to allow one or more operators to control the locomotive. Numerous remote control locomotives are normally used simultaneously in a given switching yard or remote control zone. Current radio remote control systems employing asynchronous transmission methods can only handle about 5 to 7 locomotives with associated transmitters on a single simplex wireless channel or two half duplex wireless channels (repeater system) when operating in a given location and with a given command response time. Because useable radio frequencies are limited, this effectively limits the number of remote control locomotives that can be operated simultaneously in a given switching yard or remote control zone.

Moreover, remote control systems for locomotives currently in use also typically employ only one-way data communication between the onboard controller and the operator control units, and therefore can perform only a limited number of operational and safety functions.

Additionally, current wireless remote control systems employing more than one repeater in a given switching yard or remote control zone are often hampered by interference within sub-zones where repeater coverage overlaps.

Further, current wireless remote control systems typically employ components such as radio receivers and transmitters which are always active and thus more susceptible to interference from sources outside of the system.

SUMMARY OF THE INVENTION

Accordingly, the present invention provides a system and method for remotely controlling an increased number of locomotives on a single simplex wireless channel or on two half duplex wireless channels within a given location. The system employs Time Division Multiplexing (TDM) or synchronized time sharing protocol to allow increased numbers of wireless remote control locomotives, each with a plurality of associated operator control units (OCUs), to operate on a single wireless channel or two half duplex wireless channels. Such protocol comprises dividing a cycle time into a plurality a time slots and assigning a dedicated time slot to each subsystem of a locomotive control unit (LCU) and its associated OCUs in which to communicate with each other to control the locomotive. The TDM protocol may be used in conjunction with one-way or two-way transmission systems.

A synchronization signal, such as a timing signal broadcast from a GPS satellite or a land-based time source is used to synchronize timing devices onboard the LCUs or the OCUs to ensure that the transmissions from a first LCU/OCU subsystem do not overlap those of a second LCU/OCU subsystem. The time slots for each subsystem may be assigned manually, downloaded from a computer, received from wireless transmissions over a local wireless network or automatically assigned by the LCU or OCU after monitoring the wireless channel(s) being used by the system to find an open time slot to occupy.

When employing one or more repeaters to extend the range of the system, the LCU or OCU may be set to automatically select the direct or repeater transmission path depending upon whether or not responses were received by the transmitting device to its polling messages.

Additionally, to minimize interference in sub-zones where repeater coverage overlaps, each repeater of the system is assigned a unique address. Each LCU uses GPS data provided by the associated GPS receiver to determine the sub-zone of the remote control zone in which it is located. Based upon such determination, the LCU determines which repeater to address its polling message. Repeaters not addressed within a given time slot mask off to minimize interference and/or the potential for interference within the system. Other system components such as the LCUs and OCUs also preferably mask off when not expecting to receive a system transmission to further minimize detrimental effects from extraneous transmissions and interference.

Further, in a preferred embodiment of a LCU/OCU subsystem of the present invention employing a primary OCU and a secondary OCU, the secondary OCU may be turned off and/or later rejoined to the LCU/OCU subsystem in operation without requiring a stoppage in the operation of the subsystem.

Positioning data received from a GPS receiver operably connected to the subsystem is used to determine the location of the locomotive within predefined zones and to initiate the execution of predefined functions based on the location of the locomotive.

Other features and benefits of the present invention will become apparent from the detailed description with the accompanying figures contained hereinafter.

DETAILED DESCRIPTION OF THE INVENTION

Figure 1:
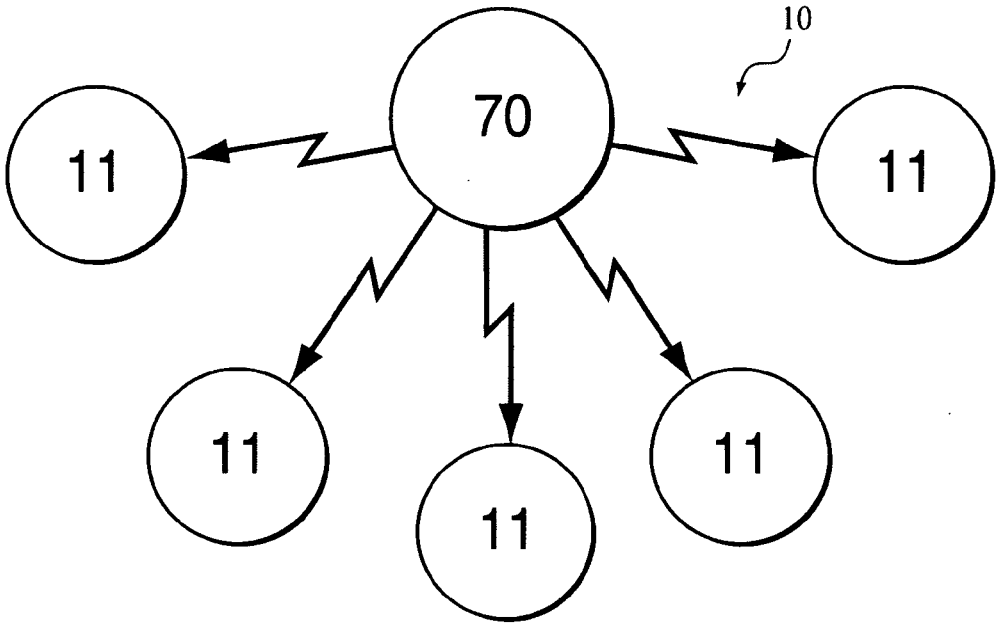
FIG. 1 is a functional block diagram of a preferred embodiment of the system present invention.

Preferred embodiments of the present invention are illustrated in the FIGURES, like numerals being used to refer to like and corresponding parts of the various drawings.

The synchronous timesharing system of the present invention maximizes Radio Frequency (RF) spectrum efficiency by allocating the spectrum to allow an increased number of remote controlled locomotives (each to be controlled by a plurality of Operator Control Units (OCUs)) to operate on a single radio frequency (simplex channel), or using a pair of radio frequencies (half duplex channel) when one or more repeaters is/are required for extended operating range. The system 10 is based upon operator response time requirements and the guidelines set forth in the FRA Advisory 2001-01, which allows for a maximum of 5 seconds of communications loss before a remote controlled locomotive must be automatically commanded to stop by the onboard locomotive control unit.

In a preferred embodiment of the present invention employing synchronized time sharing or Time Division Multiplexing (TDM), up to ten (10) controllers or Locomotive Control Units (LCUs) (each having 2 linked OCUs) can be individually programmed so that each LCU 12 polls its linked OCUs within its assigned 100 millisecond time slot that is part of a 1-second TDM cycle. These ten LCUs transmitting on the same simplex or half duplex frequency channel are individually offset by 0.1 seconds from the start of a synchronizing time pulse received by each LCU 12 from an internal Global Positioning System (GPS) receiver 23 in communication with the GPS satellite constellation. Timing means comprising internal clocks or delay timers in each LCU 12 are synchronized by this time pulse so that they can be certain to transmit only within their respective time slots and not interfere with the transmissions of other LCU/OCU subsystems.

Figure 2:
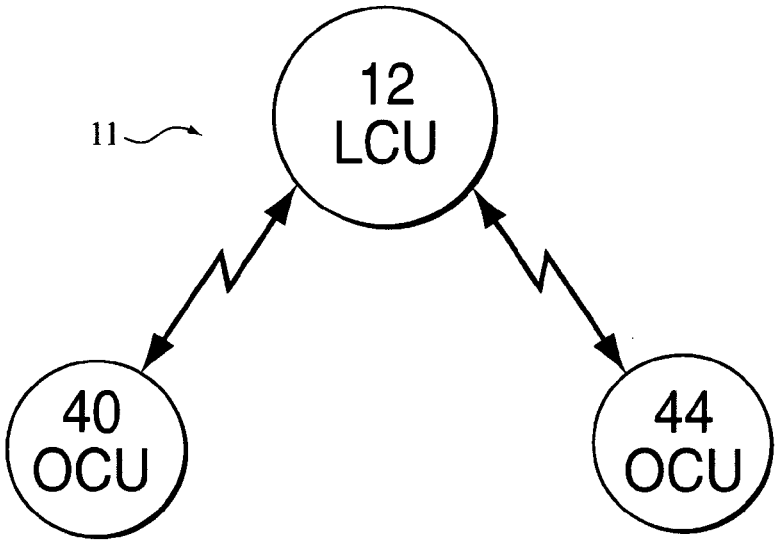
FIG. 2 is a functional block diagram of a preferred subsystem of the present invention comprising a Locomotive Control Unit (LCU) and two Operator Control Units (OCU)
Figure 3:
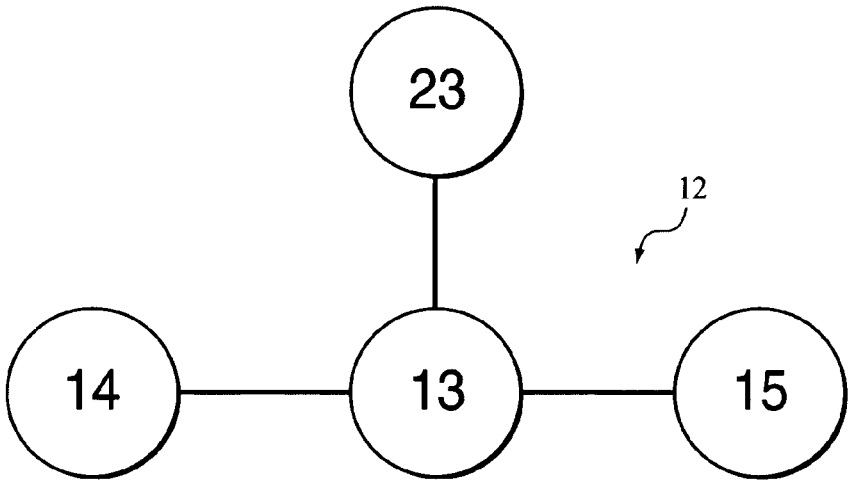
FIG. 3 is a functional block diagram of a preferred embodiment of the LCU of the present invention.
Figure 10:
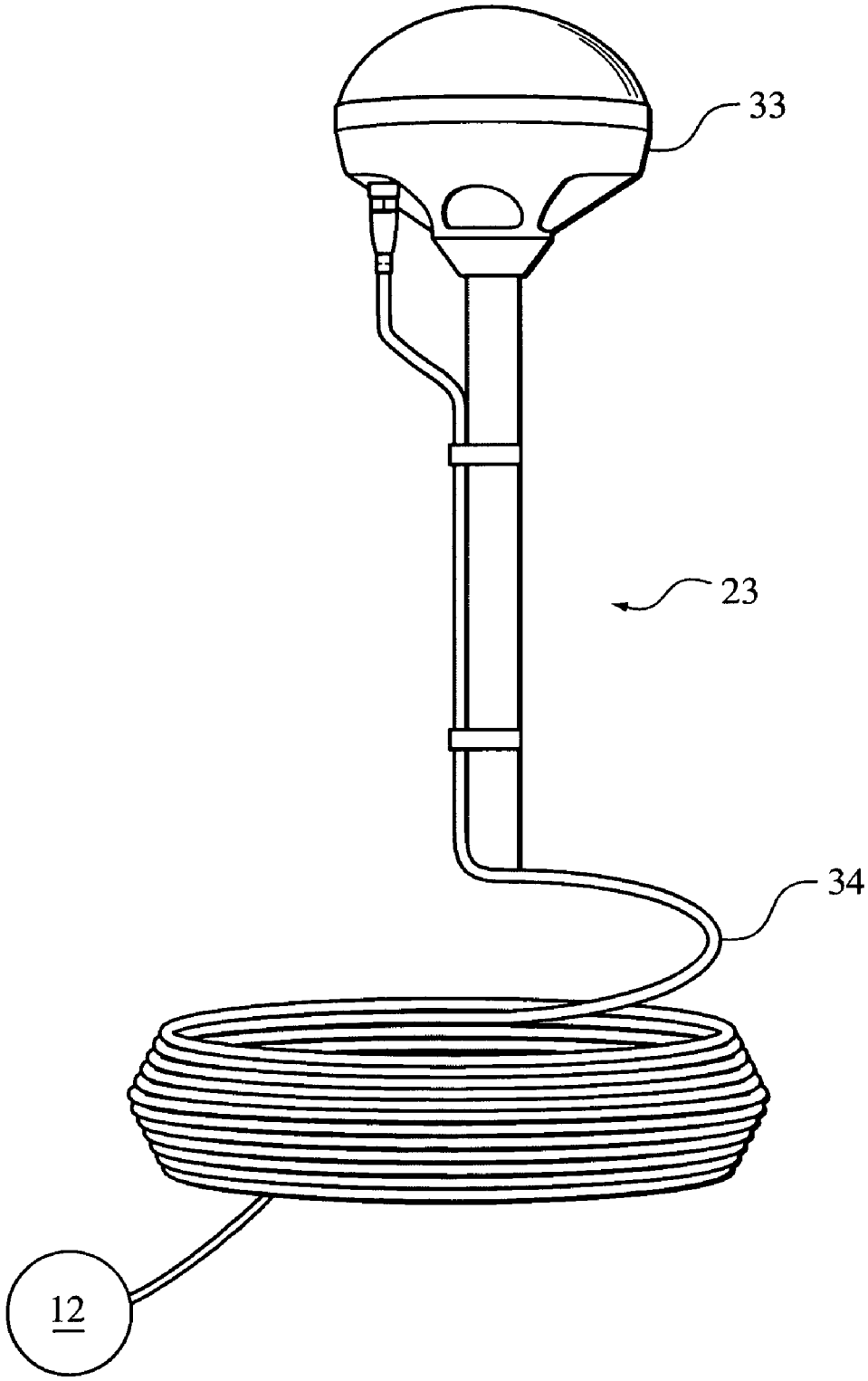
FIG. 10 is a front perspective view of a preferred embodiment of the GPS receiver of the LCU of the present invention.

FIG. 1 shows in schematic a preferred embodiment of the system 10 of the present invention comprising a plurality of subsystems 11 each of which comprises an LCU 12 onboard the locomotive, a first portable operator control unit OCU 40, a second portable OCU 44 (as shown schematically in FIG. 2). A common clock 70 is used to synchronize the internal clocks in each LCU 12 to allow for the precise Time Division Multiplexing (TDM) or synchronized time sharing on the single simplex channel or dual half duplex channels. As shown schematically in FIG. 2, each LCU 12 preferably comprises a main computer/decoder board 13, an RF transceiver 14 (alternately, separate receiver and transmitter components may be used), a power supply 15 and a Global Positioning System (GPS) receiver 23. Preferably, the GPS receiver 23 is mounted on top of the locomotive and connected to the LCU 12 via cable 34 and serial port 16 (FIGS. 6 and 10). The LCU 12 is operably connected to the pneumatic interface 7 (FIG. 5) which pneumatically executes the electronic commands from the LCU 12. The LCU 12 may also be operably connected to the junction box 8 (FIG. 5) which interfaces with the wiring of the locomotive to provide easy access thereto for purposes related to the system.

Figure 5:
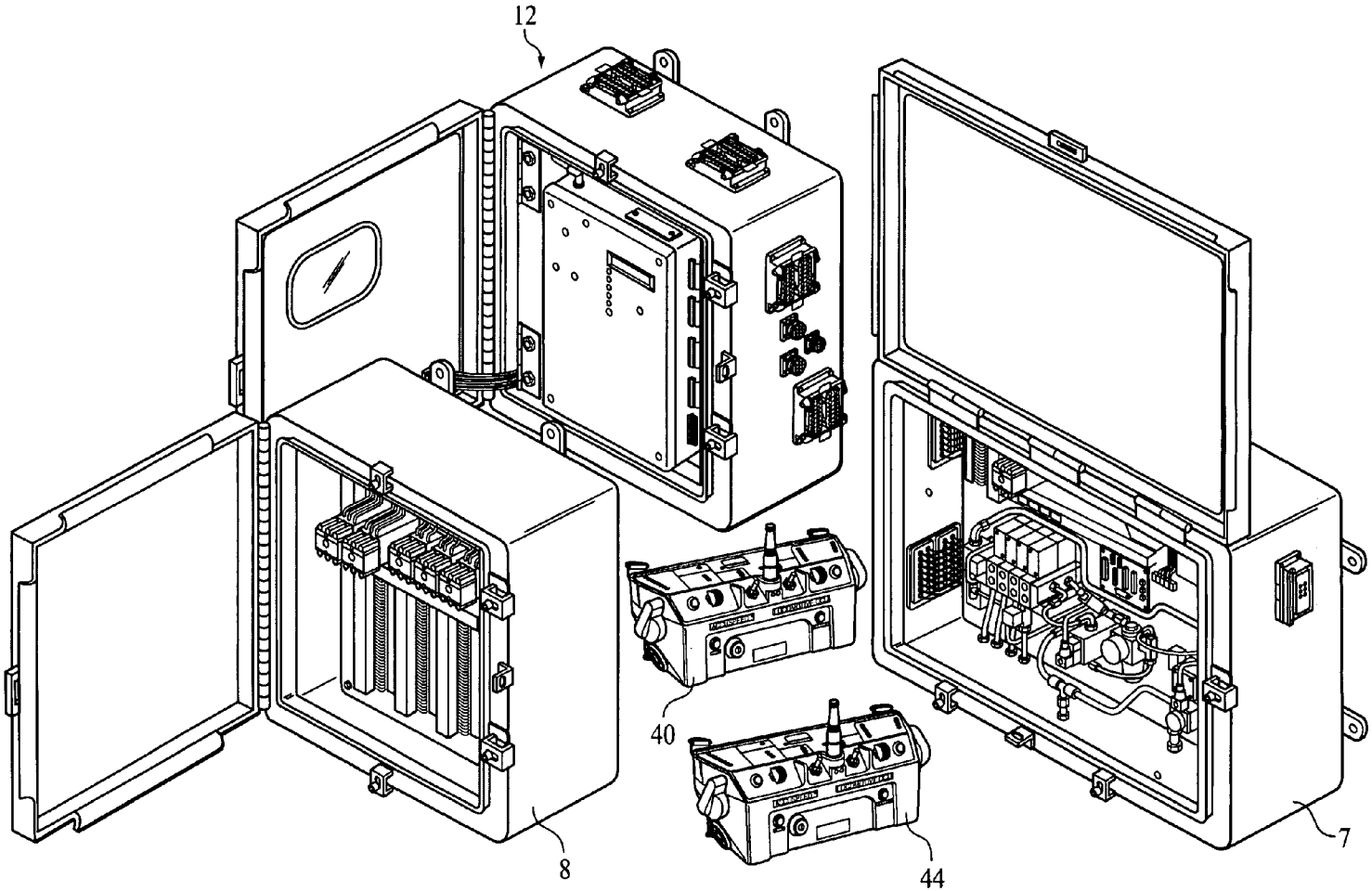
FIG. 5 is a front perspective view of the components of a preferred embodiment of the system of the present invention.
Figure 6:
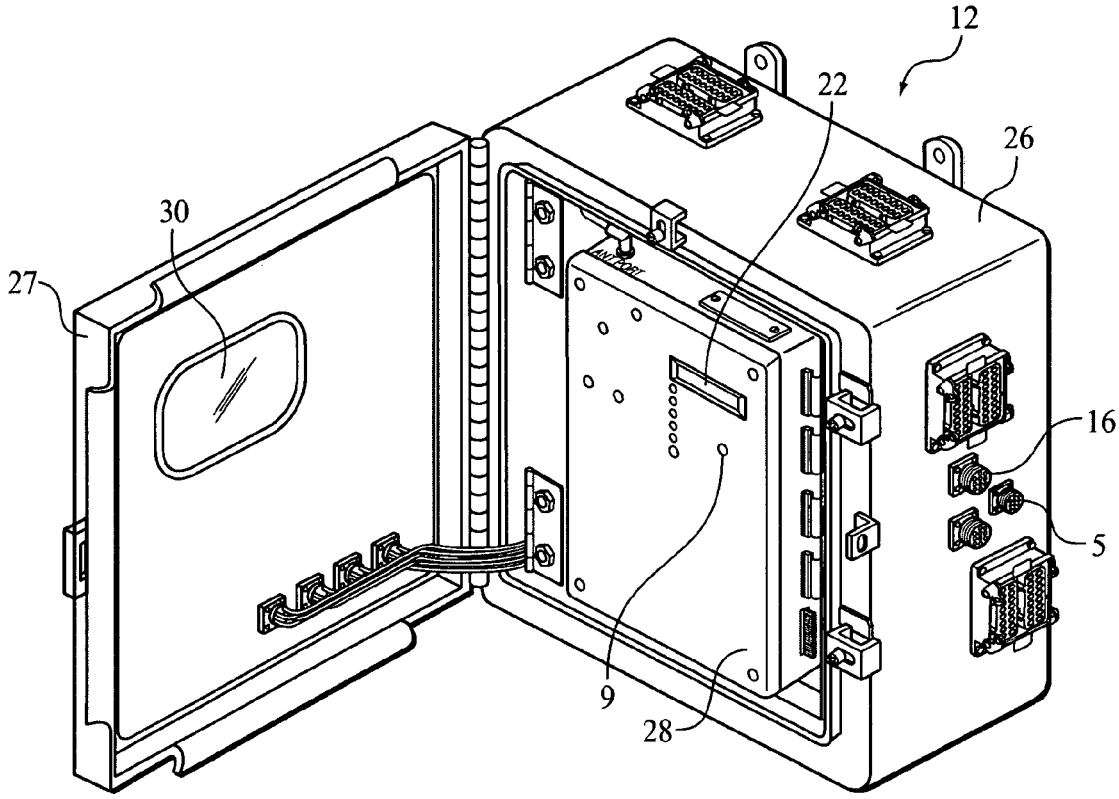
FIG. 6 is a front perspective view of a preferred embodiment of the LCU of the present invention.
Figure 7:
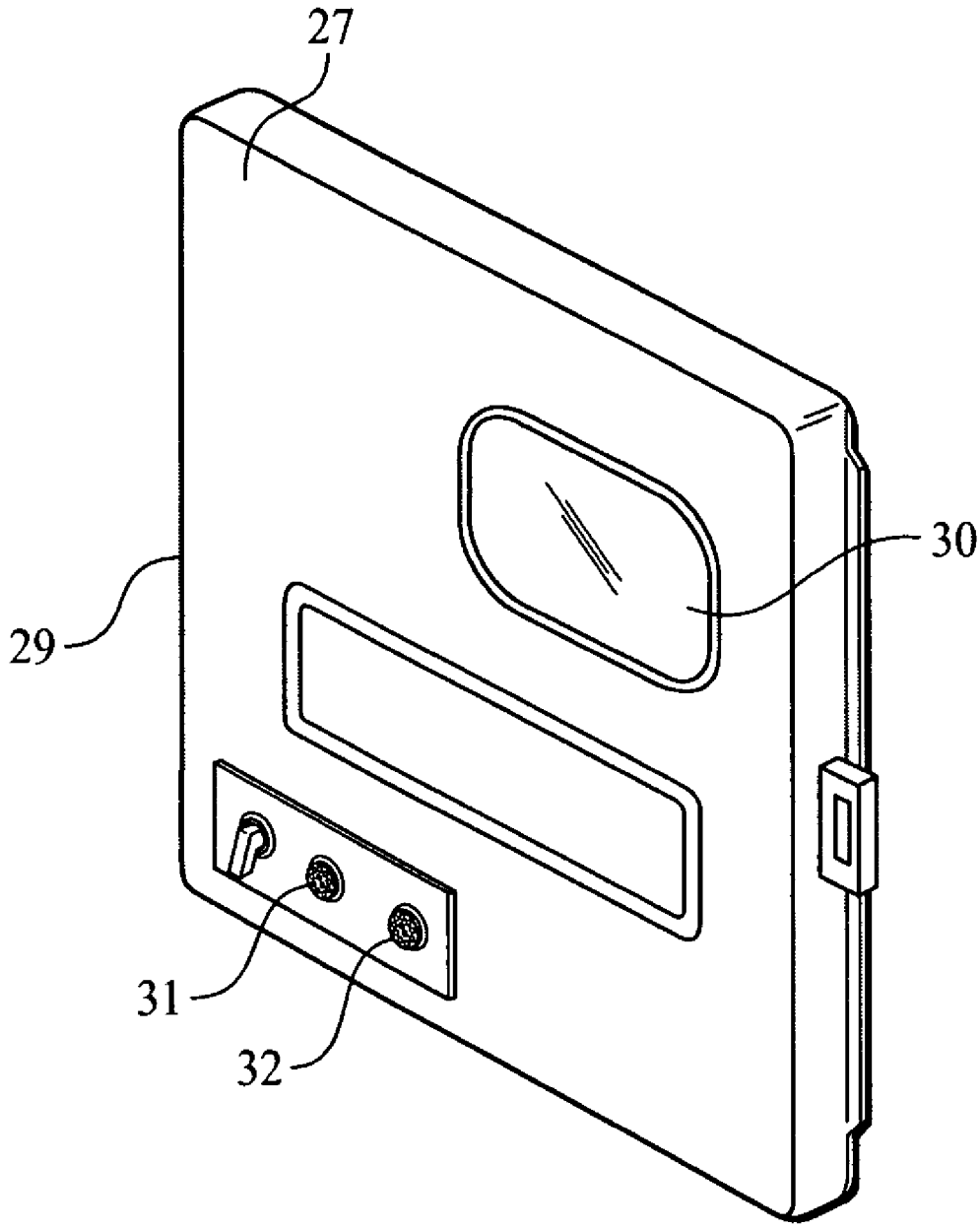
FIG. 7 is a front perspective view of the door of the LCU shown in FIGS. 5 and 6.

As shown in FIGS. 5, 6 and 7, the LCU 12 comprises an outer housing 26 with a hinged door 27 providing access to the interior of the housing 26 which contains a shielded electronics subchassis 28. The front side 29 of door 27 defines a window 30 through which the display panel 22 may be viewed. Pushbuttons 31, 32, the function of which are described below, are also disposed on the front side 29 of door 27.

Figure 4:
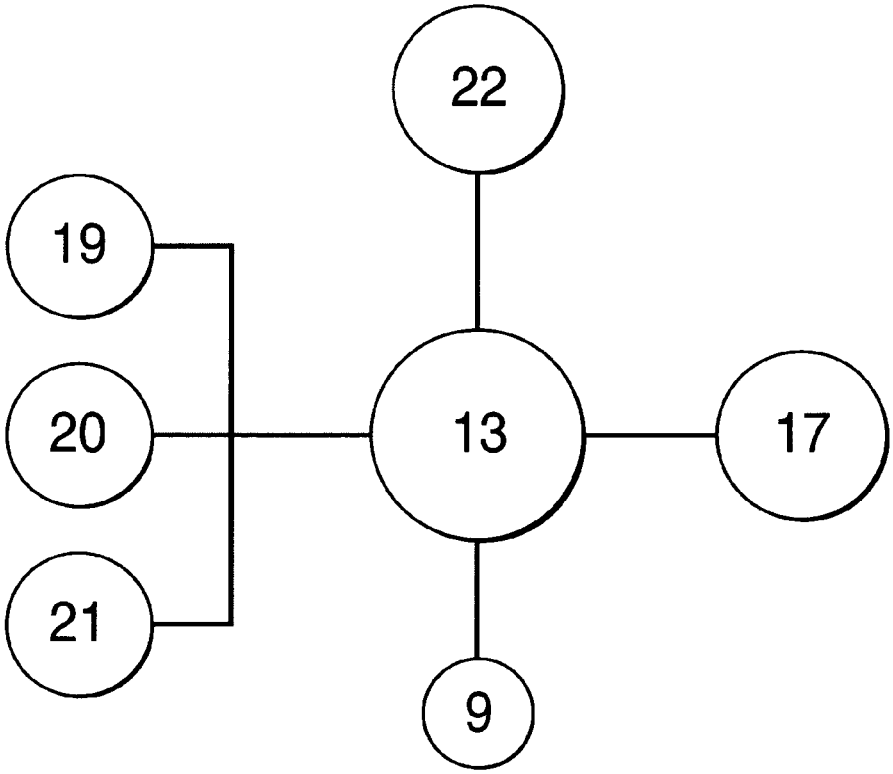
FIG. 4 is a functional block diagram of a preferred embodiment of the main computer/decoder board of the LCU of the present invention.

FIG. 4 provides a diagrammatic representation of the main computer/decoder board 13 which further comprises a real-time clock or a delay logic circuit 17 and alphanumeric display panel 22 and an I/R link port comprising an infra-red emitter/receiver 9 and several watch dog timers 19, 20 and 21. Each LCU 12 also preferably comprises a multiprocessor configuration, designed specifically to address the safety requirements of remote-controlled mobile devices such as locomotives. For example, the radio transceiver 14 of the LCU 12 performs digital signal processing as a 'screening' technique for all communications traffic. Once determined to be valid by the transceiver 14, the data message is forwarded to the first two microcomputers of the LCU 12 for simultaneous processing. The data structure and error checking insures that only the desired transmitted messages will enter the processing computer board of the LCU 12.

The computer/decoder 13 of the LCU 12 preferably comprises three microcomputers each programmed for various tasks. The control microcomputer processes the data sent to it from the radio transceiver, checking for correct address, valid data format, and complete message with a proper error checking byte appended. This control microcomputer performs all digital Input and Output (I/O) functions to the locomotive valves, relays, sensors etc, and is the primary controlling device of the LCU 12. The secondary microcomputer is utilized as a complete 'double check' of all data. This is accomplished by processing the entire command message at the same time the control microcomputer is performing the same function, after which, both microcomputers compare the results prior to activating outputs to the locomotive. The data microcomputer is responsible for storing any fault information for later retrieval and viewing, as well as managing a digital voice message via the locomotive two-way radio system to the operator control units 40, 44. This microcomputer also performs some housekeeping tasks, such as communication with the GPS receiver 23, controlling the output to the status display 22, and controlling the IR 'Teach'/'Learn' during the OCU/LCU linking process.

Figure 8:
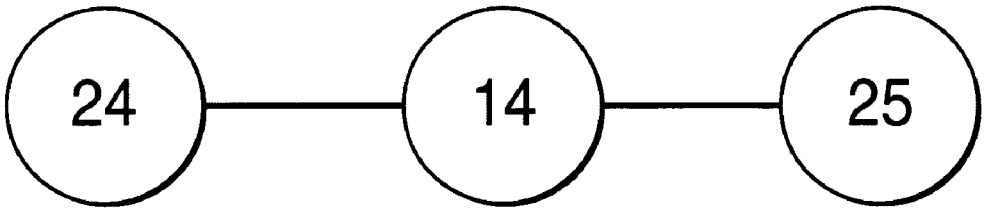
FIG. 8 is a functional block diagram of a preferred embodiment of the transceiver of the LCU of the present invention.

The RF-transceiver 14 of the LCU 12, shown schematically in FIG. 8, comprises an alphanumeric display 24 and a supervisory timer 25.

Figure 9:
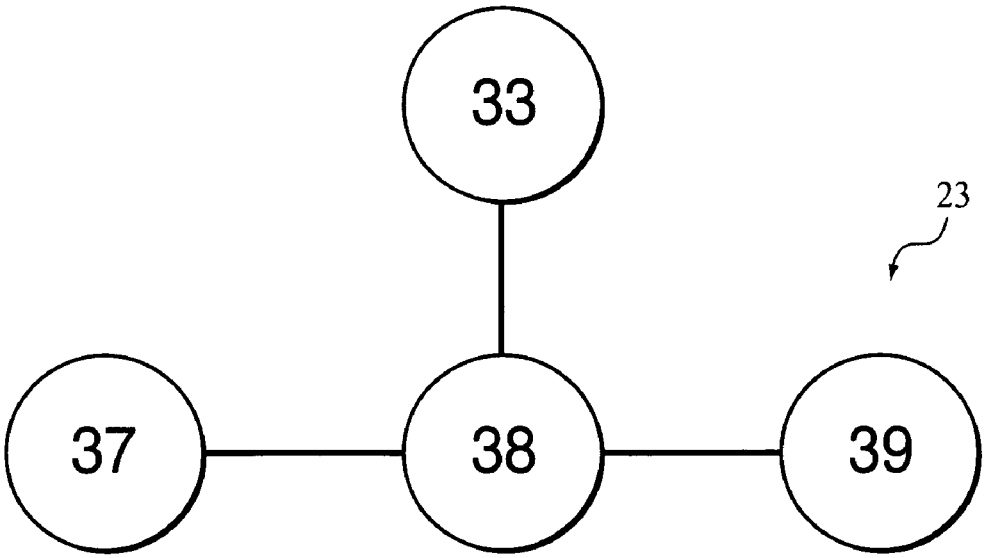
FIG. 9 is a functional block diagram of a preferred embodiment of the Global Positioning System (GPS) receiver of the LCU of the present invention.

The GPS receiver 23, shown in further detail in FIGS. 9 and 10, comprises a satellite receiver 37, a microprocessor 38, a clock 39, an antenna 33 and interface cable 34 to the LCU 12. When powered up, the GPS receiver 23 self-initializes, acquires satellite signals from the national GPS satellite constellation, computes position and time data, and outputs such data to the LCU 12. The internal clock 39 of the GPS receiver 23 is preferably highly accurate and is synchronized by a signal from one of the very highly accurate clocks onboard the satellites of the national GPS satellite constellation. In addition, the GPS receiver 23 generates a Pulse Per Second (PPS) output to the LCU 12 synchronized to Coordinated Universal Time (UTC) within 50 nanoseconds (1 sigma). The Acutime™ 2002 GPS Smart Antenna and Synchronization Kit available from Trimble Navigation Limited, Sunnyvale, Calif., is a commercially available GPS receiver of the type disclosed herein.

As an alternative to GPS receiver 23, the means for receiving a synchronization signal of the LCU 12 could comprise a receiver (not shown) for receiving the time signals broadcast by the Time and Frequency Division of the National Institute of Standards and Technology over the WWV, WWVB or WWVH radio stations for the purpose of synchronizing a clock, timer or delay logic circuit of each LCU 12. Further, a private radio broadcasting station could be constructed within the railyard or a remote control zone to broadcast time signals generated by a clock of very high accuracy, such as an atomic clock for example, to be received by a dedicated receiver in each LCU 12. In addition, time signals can alternatively be transmitted to each LCU 12 within a given location by other means such as infra-red or other light transmissions, or a wireless computer network in which case each LCU 12 would also comprise a wireless network card (not shown). In summary, each LCU 12 preferably comprises means for synchronizing the LCU 12 with an external timing source for the purpose of Time Division Multiplexing (TDM). The means for synchronizing would preferably comprise a means for receiving a synchronization signal from the external timing source and a timing means such as a clock or a delay logic circuit. The means of the LCU 12 for receiving the synchronization signal preferably comprise a GPS receiver, an infrared receiver, a radio receiver or a wireless network card.

Individual rail yards or remote control zones are allocated specific radio frequency channels that are normally duplicated at other rail yards and remote control zones. Remote control locomotives with onboard LCUs operating within an individual rail yard or remote control zone are programmed with matching radio frequency channels.

Each LCU 12 operating within an individual rail yard or remote control zone is allocated a specific time slot in which to transmit polling messages to its associated OCUs. Initially, this time slot is factory programmed for a particular rail yard or remote control zone so that the LCU 12 fits into the wireless 'time-sharing' sequence plan or TDM plan for that location. The programmed frequency and address of each LCU is transferred to one of many associated Operator Control Units (OCUs) during a teach/learn process (described below) by way of an Infra-Red (IR) link.

Consequently, if an LCU 12 is moved out of its designated rail yard or remote control zone, its frequency channel and time slot allocation must be reprogrammed to fit in with its new rail yard or remote control zone.

It is recommended that up-to-date records be kept of individual frequency and time slot allocations for each LCU 12 at individual rail yards and/or remote control zones, including any new frequency and time slot allocations made in the field by maintenance or operating personnel. Such records will help to ensure that no two LCUs have been assigned the same time slot. Duplicating time slots may result in unexpected communications losses that may cause the affected LCUs to shut down.

In the preferred embodiment of the present invention, various programming options may be used to program the frequency and time slot allocations for each LCU 12.

In a user select option, yard employees can select from pre-programmed frequency channels stored in the LCUs memory and similarly select the time slot for the LCU to occupy in the wireless 'time-sharing' sequence or TDM plan. The channels and time slot are changed using the existing function pushbuttons 31, 32 located on the front side 29 of LCU door 27 while observing prompts on the alphanumeric display 22 as viewed through the front door window 30 of the LCU 12 (FIGS. 6 and 7).

In the manual procedure for field selection of an RF channel, the operator presses and holds the 'YES/ALARM RESET' button 32 for longer than 2 seconds, releases the button for longer than 2 seconds, and repeats this cycle a total of three times. The display 36 will then indicate 'SELECT RF CHANNEL 1L'. The 'NO/FUNCTION' button 31 is then used to increment from 1 through 30 channel numbers. When the desired channel number (e.g., 1H) has been selected, the 'YES/ALARM RESET' button 32 is pressed to lock the LCU 12 on the channel number displayed. Once a channel is selected, the status display 22 changes to indicate "SELECT TIME SLOT 1". Again, the 'NO/FUNCTION' button 31 is used to increment between time slots 1 through 10. When the desired time slot has been selected, the 'YES/ALARM RESET' button 32 is pressed to lock the LCU 12 on that time slot. The LCU 12 display 22 will show the channel and time slot selections and ask if they are correct. Here, the 'YES/ALARM RESET' button 32 is pressed to complete the selections or the 'NO/FUNCTION' button 31 is pressed to start over.

The LCU channel and time slot selections may also be downloaded to the LCU 12 from a portable computer via known linking/transfer means including an infrared port, a wired or wireless network or a serial cable connected to a communications (COM) port located on the underside of the shielded electronics sub-chassis 28 of the LCU 12. The download is performed by first opening the front door 27 and turning OFF the power to the LCU 12 using a power switch (not shown). The portable computer is then connected to the COM port (not shown) on the sub-chassis 28 using a serial cable with a DB-9 connector (this may require disconnecting an optional event recorder). Instead of connecting a portable computer to the COM port, an interface cable may be provided to allow the computer to interface directly to the external connector 5 on the enclosure 26. Once connected to the LCU 12, the desired table of frequencies and parameters are downloaded into the battery backed memory of the LCU 12. The LCU 12 is then turned on and the upload button (not shown) is selected to complete the transfer of information. The newly programmed information can then be read and verified on the LCU display 22. The serial cable is disconnected and the door 27 is closed and secured to complete the process.

Additionally, pre-programmed radio or other wireless communications channel frequencies stored in memory in the LCU 12 may be selected automatically by the LCU 12 based upon position data from the GPS receiver 23. Known radio frequencies used at various geographic locations can be stored in the LCU's memory and automatically selected when, via GPS, the locomotive determines that it has entered a location or zone requiring a different channel selection. Other position determining means may consist of inertial guidance systems and other radio navigation technology such as Loran, local pre-surveyed position transmitters, and local area networks.

In a similar manner, the onboard LCU 12 can use the position data provided by the GPS receiver 23 to establish yard limits to prevent a locomotive from operating outside of a defined geographic location. Using GPS, the LCU 12 could be programmed to command a full service shutdown and emergency brake application if the locomotive traveled outside of the defined yard. GPS data from the GPS receiver 23 can also be employed to detect false standstill signals provided to the LCU 12 by an onboard velocity/direction sensor, such as an axle pulse generator of the type well known in the art as disclosed in U.S. Pat. No. 5,511,749 incorporated by reference herein, which has failed. Here, the LCU 12 would compare sequential signals from the GPS receiver 23 to determine if the locomotive is moving and the direction of movement. If this data contradicts data received from the velocity/direction sensor, the LCU 12 would command a full service shutdown and emergency brake application.

Electronic Position Detection (EPD)

In a preferred embodiment of the Electronic Position Detection (EPD) system of the present invention, the LCU 12 is programmed to automatically slow and/or stop the controlled locomotive within pre-defined zones, or at specific locations on the track. Additionally, the LCU 12 can be programmed using positional information from the GPS receiver 23 to override excessive speed commands from the OCUs 40, 44 within specified areas.

There are two (2) independent EPD systems that may be programmed into the LCU 12, EPD-GPS & EPD-TAG. Each can be programmed to work as a primary or back up system to the other.

(i) TAG READER SYSTEM (EPD-TAG): The first (primary if used) position detection system is a transponder system. The system consists of a radio frequency (RF) interrogator reader and attached antenna system which are mounted on the locomotive, providing input data via communications software within the LCU 12. For speed limiting applications, a comprehensive track profile study is completed prior to programming. The engineering and programming is based on parameters such as track grade, curves, maximum train tonnage and weakest motive power used to pull the train. Once design is complete, passive transponders are placed in the track at positions where the required action is to be taken. As the locomotive passes over the transponders, the EPD-TAG system will sense the transponder and pass data via radio to the transceiver 14 of the LCU 12, which will in turn carry out the pre-defined operation.

Each tag is pre-programmed with a 10 digit ID representing the action to be taken. The format of information contained in the tag is as follows:

Digits 1-2: Speed limit of locomotive until next transponder is read. Speed can be programmed from 0-15 MPH in 1 MPH increments (D1 represents the ten digit and D2 represents the one digit—i.e. 10 would have D1=1 and D2=0, 9 would have D1=0 and D2=9, etc.) . For tags being used to identify a track that is not subject to pullback protection, the tag will be programmed with 99 for D1 and D2.

Digits 3-4: Used as a check to ensure proper interpretation of the read tag. These two digits are calculated by taking the absolute value of 90-D1D2.

Digits 5-10: Programmed with a 0 in each position (unused).

Programming chart for tags:

| | D1 | D2 | D3 | D4 | D5 | D6 | D7 | D8 | D9 | D10 |
|---|---|---|---|---|---|---|---|---|---|---|
| 10 MPH | 1 | 0 | 8 | 0 | 0 | 0 | 0 | 0 | 0 | 0 |
| 9 MPH | 0 | 9 | 8 | 1 | 0 | 0 | 0 | 0 | 0 | 0 |
| 8 MPH | 0 | 8 | 8 | 2 | 0 | 0 | 0 | 0 | 0 | 0 |
| 7 MPH | 0 | 7 | 8 | 3 | 0 | 0 | 0 | 0 | 0 | 0 |
| 6 MPH | 0 | 6 | 8 | 4 | 0 | 0 | 0 | 0 | 0 | 0 |
| 5 MPH | 0 | 5 | 8 | 5 | 0 | 0 | 0 | 0 | 0 | 0 |
| 4 MPH | 0 | 4 | 8 | 6 | 0 | 0 | 0 | 0 | 0 | 0 |

-continued

| | D1 | D2 | D3 | D4 | D5 | D6 | D7 | D8 | D9 | D10 |
|---|---|---|---|---|---|---|---|---|---|---|
| 3 MPH | 0 | 3 | 8 | 7 | 0 | 0 | 0 | 0 | 0 | 0 |
| 2 MPH | 0 | 2 | 8 | 8 | 0 | 0 | 0 | 0 | 0 | 0 |
| 1 MPH | 0 | 1 | 8 | 9 | 0 | 0 | 0 | 0 | 0 | 0 |
| 0 MPH | 0 | 0 | 9 | 0 | 0 | 0 | 0 | 0 | 0 | 0 |
| No Pullback | 9 | 9 | 0 | 9 | 0 | 0 | 0 | 0 | 0 | 0 |

Some features of the transponder system are:

(a) The transponder system does not require an FCC license.

(b) The unit will work through snow, ice, concrete, wood, rocks and other non-metallic materials that may be present in a typical yard environment.

(c) The system is limited to a maximum operating speed of 30 MPH.

The above programming allows the tags used throughout the railroad to be kept "generic". A track profile will be created and stored in the LCU 12 specifying the distance to next tag and distance to end of pullback authority. When a locomotive is moved between yards, the track profile for the new yard will need to be entered into its LCU 12. The LCU 12 will continuously search for transponders.

(ii) GPS BASED ZONE IDENTIFICATION SYSTEM (EPD-GPS) This equipment and software may be the primary stand alone system, or a secondary system used to back-up the primary tag reader system. The LCU 12 utilizes the positional information from the GPS receiver 23, with software additions to the LCU 12 for implementation.

Two position points, identified by latitude/longitude coordinates for each point, are entered into the LCU 12 to define the opposite corners of the boundary for each predefined zone. The size and shape of the zone is then determined. These zones may be as small as the tolerance of the GPS receiver accuracy, (typically 50 feet in diameter or three feet in diameter using differential GPS) to as large as an entire yard location. Once identified, the boundaries form a rectangle that can be overlaid on to a yard map, creating a specific zone number. Zones can be overlaid for multiple functions or limits in the same area. For example, a large zone may have a limit of 4 MPH, with an underlying zone having a stop area defined within the larger zone.

The functional purpose of the zone will determine the number of zones required. Additionally, the placement and size of the zones requires a study to be performed, determining the areas of operation, the critical areas for these operations and a risk analysis by the railroad to determine if additional safety devices are required in specific locations (i.e. derailers, etc.). The zones will have a tolerance based upon the GPS error at the proposed location, the timing within the LCU and the error within the GPS system itself. This can be accounted for in the design of the zone application.

Once the zones are established, additional programming is downloaded to the LCU to interact with the OCUs to perform the functions necessary, as well as inform the OCU operator with any text status pertinent message.

Locomotive operation between zones can be detected and used in programming functionality within the LCU 12 (e.g. limit speed in one direction, but not the other) Track profiles and zones can be loaded into the LCU 12 using a laptop PC, via a serial connection or wireless LAN.

Additionally, there will be an override function that can be enabled from the LCU 12. This will allow the operator to bypass the EPD system and continue the move out of the protected limits. This override must be initiated on the locomotive to ensure that the operator is "at the point" prior to commanding the movement without protection.

Figure 11:
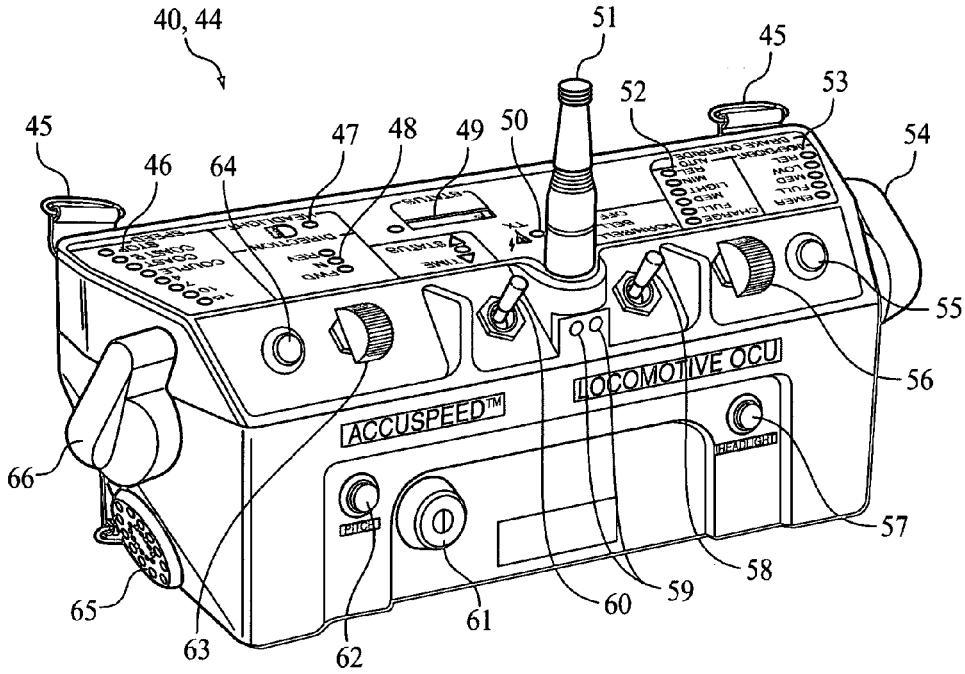
FIG. 11 is a front perspective view of a preferred embodiment of an Operator Control Unit (OCU) of the present invention.
Figure 12:
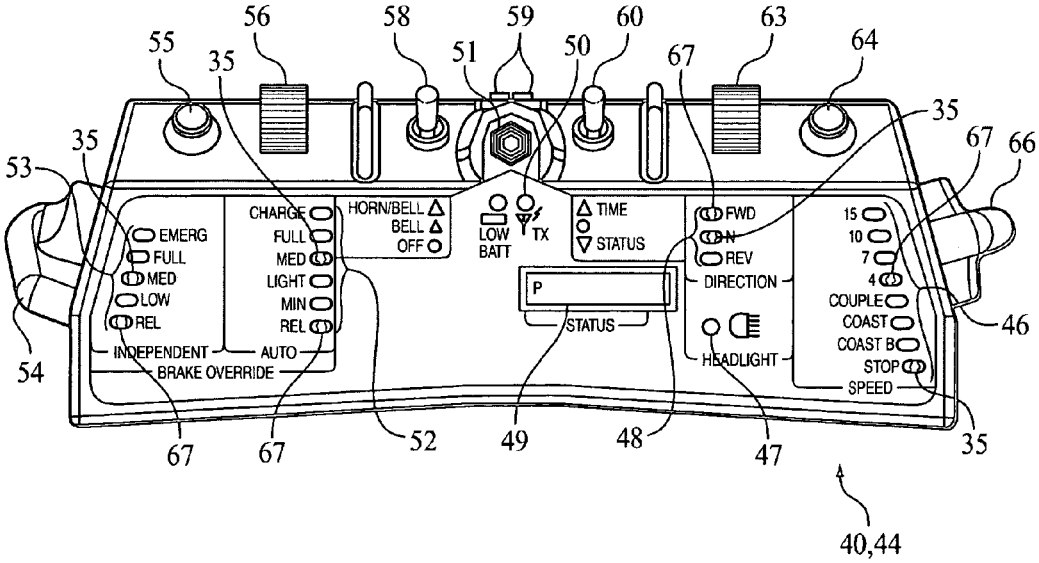
FIG. 12 is a top perspective view of the OCU shown in FIG. 11.

FIGS. 11 and 12 illustrate a preferred OCU of the present invention. As both OCUs 40, 44 are identical, the following description is equally applicable to both and like reference numerals have been used to refer to the components of each OCU 40, 44. Each OCU 40, 44 comprises a pair of harness mounting clips 45 for attaching a harness worn by the operator to carry the OCU. An on/off button 61 is used to turn on or shut off the device. Various LED indicator lights on the OCUs include speed indicators 46, headlight brightness indicator 47, forward, neutral and reverse direction indicators 48, transmit and low battery indicators 50, automatic brake position indicators 52 and independent brake position indicators 53. Text and status display 49 shows text and status messages received from the LCU 12 and from the other OCUs (in a two OCU set-up). A transceiver (not shown) and antenna 51 of each OCU 40, 44 transmit signals from the OCUs and is used to receive signals from the LCU 12, repeater 80 (when part of the system) and the other OCU (in a two OCU set-up). Each OCU 40, 44 may also preferably comprise means for synchronizing the OCU with an external timing source for the purpose of Time Division Multiplexing (TDM). Here, the means for synchronizing would preferably comprise a means for receiving a synchronization signal from the external timing source and a timing means such as a clock or a delay logic circuit. The means of the OCU for receiving the synchronization signal preferably comprise a GPS receiver, an infrared receiver, a radio receiver or a wireless network card.

The independent brake selector lever 54 and automatic brake selector 56 allow the operator to override the automatic speed control of the LCU 12 and command settings of the independent and automatic brakes, respectively. The speed selector lever 66 allows the operator of the OCU to command various speeds of the locomotive.

While the speed setpoints are fully programmable to suit any application, they are generally set with the following settings. The "STOP" setting when commanded brings the locomotive to a controlled stop by returning the throttle to idle and commanding a full service reduction of the brake pipe and a full application of the independent brakes. The "COAST B" setting returns throttle of the locomotive to idle and applies 15 pounds of independent brake pressure, allowing the locomotive to gradually come to a stop. The "COAST" setting returns the throttle of the locomotive to idle and allows the locomotive to coast without brake application. In both the "COAST B" and "COAST" settings, if the speed of the locomotive increases above a pre-determined set point (e.g. 7 mph) independent braking will be applied until the locomotive slows below the set point. In the "COUPLE" speed setting, the LCU 12 automatically adjusts the throttle and brake settings to maintain a speed of one mph ±0.1 mph. Likewise in the speed settings for 4 mph, 7 mph, 10 mph, and 15 mph, the LCU automatically adjusts the throttle and brake settings to maintain those respective speeds ±0.5 mph. To prevent accidental speed selection commands from lever 66 when moving from the STOP position to a different speed setting, the operator must first activate either vigilance pushbutton 55, 64, then select the desired speed within 5 seconds. If the operator fails to select the speed within the 5 second window, he will be required to activate either vigilance pushbutton 55, 64 again before making the speed selection.

The three-position toggle switch 63 allows the operator to command the following direction of travel: forward, neutral and reverse. If direction is changed while the locomotive is moving, a full service reduction will be automatically commanded by the LCU 12. Additionally, any time a direction of travel opposite to the commanded direction of travel, as determined by the velocity/direction sensor or the LCU 12 with input from the GPS receiver 23, persists for longer than 20 seconds while the OCU is commanding movement, a full service reduction will also be automatically commanded by the LCU 12.

The two multiple function pushbuttons 55, 64 are used to reset vigilance timers, acknowledge warning signals sent by the LCU 12 and accept a "pitch" of control authority from the primary OCU. When the OCU is the primary OCU 40, the pitch pushbutton 62 may be used to transfer control authority to the secondary OCU 44. The secondary operator must accept such transfer by pushing either of the buttons 55, 64 to complete the transfer of control authority. Additionally, the pushbuttons 55, 64 when held for longer than 2 seconds, will command that sand be dispensed in the direction of travel for as long as the pushbuttons are depressed. The operator is required to activate a control function at least once every 60 seconds. If the operator fails to change the state of any of the control functions for 50 seconds, the OCU will begin to emit a pulsed audible warning from the sonalert (beeper) 65. Either prior to, or during the audible warning, the operator is required to reset the vigilance system timer by activating either of the vigilance pushbuttons 55, 64. If the operator fails to reset the vigilance system, a full service reduction shutdown of the automatic brakes will be automatically commanded by the LCU 12. The vigilance system is only active and required on the primary OCU 40 and only when a speed other than STOP is selected by the operator.

The bell/horn toggle switch 58 has one momentary and two maintained positions. When the switch 58 is held in the momentary position, the OCU commands the LCU 12 to ring the bell of the locomotive and sound the horn for as long as the operator maintains the switch in this momentary position. When moved to the center position, the switch 58 turns on the locomotive's bell and when moved to the third position, turns off both the bell and the horn.

An internal tilt switch senses when either the OCU 40, 44 is tilted more than 45°±15° past upright and sends a shutdown command to the LCU 12, which, in turn, commands an emergency brake application, returns the throttle to idle and activates a remote man-down synthesized voice transmitter. When the OCU is tilted beyond limits for one second, the OCU will begin emitting an audible warning from beeper 65 alerting the operator that he is about to enter into a tilt shutdown. If the operator does not return the OCU 40, 44 to an upright position within 5 seconds from the time the warning sounds, the shutdown command will automatically be sent to the LCU 12. Using the time/status toggle switch 60, the tilt shutdown feature can be delayed for a preset time (e.g. 15 seconds) when the switch 60 is moved to the time position (the locomotive must also be at a complete stop for such time extension). Additional time cannot be added by repeatedly commanding or maintaining the time feature. If the operator has not returned the OCU to an upright position before the preset time expires, the LCU 12 will automatically command an emergency shutdown. When the switch 60 is moved to the status position, the output on display 49 will be updated with any relevant text message.

Typically, the independent brake override lever 54 is configured with the following selections. When the "REL" position is commanded, the independent brakes are released and placed under the control of the LCU 12 for maintaining the speed selected by lever 66. When the lever 54 is set to "LOW", "MED" and "HIGH", 15 pounds, 30 pounds and 45 pounds of independent brake pressure are applied respectively. When the lever 54 is set to the "EMERG" position, the throttle is set to idle and an emergency application of the automatic braking system is commanded by venting the brake pipe to atmosphere, thus commanding a full reduction of the train brakes as well as an emergency application of the independent brakes.

The automatic brake override toggle switch 56 is a three position switch with the following positions: forward is a momentary setting which allows toggling of the selection towards the "CHARGE" setting as shown in FIGS. 11 and 12. The hold position (center) holds the current selection and the reverse toggles the selection towards the "REL" or release setting. The following settings can be selected: the "REL" setting commands a release of the automatic brakes and places them under the control of the LCU 12 for maintaining the speed selected by lever 66. Three conditions are required for an automatic brake release: (1) the main reservoir air pressure must be greater than a preset point (e.g. 100 psi), (2) a suitable brake pipe leakage test must have been passed and (3) at least 90 seconds has elapsed since a previous release was commanded. The "MIN", "LIGHT", "MED", and "FULL" positions command 7 lb., 12 lb., 18 lb., and 27 lb. reductions of the brake pipe pressure, respectively. The "CHARGE" setting commands a release of the automatic brakes until a sufficient charge is detected on the brake pipe and movement of the locomotive is disabled until a full charge is detected.

The OCUs 40, 44 will have two free running firmware clocks set to provide the following:

The first clock is approximately 250 ms and performs a switch read at "wake-up". The second clock will "wake up" the OCU processor at approximately 950 ms after receipt of the last polling message/synchronization.

The first clock gives the signal for the OCU to read and store in memory momentary switch positions every 250 ms. The second clock signals the OCU to read all other switches at the 950 ms time period and to:

(i) build the switch position message to be transmitted to the OCU 12;

(ii change the state of LEDs on the OCU to the status reported by the previous polling message from the LCU 12;

(iii) activate the RF receiver of the OCU to receive the next polling message from the LCU 12; and (iv) hold the data to be transmitted in a "ready to transmit state" until the second clock expires at 1000.01 ms from the last synchronization or transmit data upon receipt of the new polling message from the LCU 12 which generates a new synchronization pulse right after the message is successfully decoded by the OCU, whichever occurs first. Normally, the new synchronization at 1000 ms from the time of the prior polling message will occur first.

The OCUs 40, 44 will have two RF message structures that are responses to polling messages from the LCU 12:

(i) The RF initialization messages (one from each OCU 40, 44)—primary OCU 40 response is approximately 36 ms and secondary OCU 44 response is approximately 27.4 ms.

(ii) The RF operational messages (one from each OCU)—primary OCU 40 response is approximately 36.1 ms and secondary OCU 44 response is approximately 23.1 ms.

In addition, an allowance comprising an additional few milliseconds of time in the overall process to allow for a free running (non-synchronized) clock state in the LCUs and/or OCUs.

Since the system preferably updates messages once per second, it is possible for the operator to press and release momentary functions on the OCUs in less time than the one second message update. For this reason, it is necessary to evaluate each momentary function in order to accommodate this type of operation. Momentary OCU functions are: Vigilance Reset, Accept Pitch, Sand, Horn/Bell, Status Request, Time Extend, and Headlight.

Generally, the situation and performance requirements for the OCUs 40, 44 will be satisfied in one of three ways:

(1) Constantly sample each switch of each OCU 40, 44 at 250 ms intervals. This will be the minimum switch activation time (average of 125 ms). This results in any switch operation being "de-bounced" and therefore requires the operator to hold the intended switch function for at least this length of time. Switch sampling will be processed by either the display CPU or the M840 CPU of each OCU 40, 44.

(2) A bit will be included as part of each poll request from the LCU 12. This bit will "inform" the OCU's 40, 44 that the LCU 12 has successfully received a valid message from each operating OCU 40 and 44 within the previous one second. This bit will be used as a "cancellation bit" and normally will be a zero (0) but set to a one (1) as the result of recognizing two "good messages," one from each of the OCU's 40, 44 (only one good response required if in single operator mode). The cancellation bit will be sent in every poll message.

(3) VIGILANCE Reset, ACCEPT and SAND functions are all part of the same switch on the OCUs 40, 44. There are two of these switches 55 and 64, one on the left front corner of each OCU 40, 44 and the other on the right front corner of each OCU 40, 44. The OCU program will read both of these switches 55 and 64, and perform as follows:

If pressed and held for >250 ms but <two seconds, the VIGILANCE (ACCEPT) will be sent from the OCU for 5 seconds, or until canceled by receiving the "cancellation" bit prior to the 5 second expiration. Notice, that the VIGILANCE bit is used to perform the ACCEPT function at the decoder end of the system. There is no need for a unique bit.

If pressed and held for >two (2) seconds the SAND bit will be sent for 5 seconds or until canceled by receiving the "cancellation" bit prior to the 5 second expiration.

For the HEADLIGHT, STATUS AND TIME switches, when pressed and held for >250 ms, their respective function bits will be sent from the OCU for 5 seconds, or until canceled by receiving the "cancellation" bit prior to the 5 second expiration.

The HORN/BELL switch 58 will have two bits associated with its activation. If the switch is detected as being pressed and released for <one (1) second, it will send the "short horn" bit. This bit will be programmed at the LCU 12 to provide a "one shot" timer to the horn of approximately ½ second. If the switch 58 is detected as being pressed for >1 second, it will send the "long horn" bit which will be transmitted for 5 seconds, or until the cancellation bit is received at the OCU.

Initialization of the System Prior to Radio Communications

In a preferred embodiment of the system 10 of the present invention, a unique digital permanent address is embedded within each LCU 12. Each OCU 40, 44 also has a unique digital permanent address embedded at the time of manufacture. The permanent 16-bit address identification used in the present invention prevents accidental duplication by maintenance personnel, and when combined with the LCU address of 16 bits, results in a potent system identifier.

In order for the LCU 12 and the OCUs 40, 44 to operate as a system, they must first exchange their digital addresses to associate the OCUs 40, 44 with the LCU 12. In this manner, the LCU 12 will recognize and accept signals from only the OCUs 40, 44 and not from any others. The operation of the system 10 begins when two operators, each carrying one of the OCUs 40, 44 with a fully charged battery, board the locomotive. Once onboard the locomotive, the operators will start the engine in the normal manual fashion. All safety procedures and operational characteristics of the locomotive are confirmed to be working properly. The locomotive is then transferred to "Remote" mode using designated selector switches and valves.

Next, the operators approach the window 30 of the onboard LCU 12 and one at a time, with the "primary" operator first entering a teach/learn mode using the designated pushbuttons sequence on his portable OCU 40. A menu on the display screen 49 of each OCU 40, 44 prompts the operators through the sequence necessary to transfer information from the LCU 12 into each of the OCUs 40, 44 and vice versa. The infra-red teach/learn process of the present invention between the LCU 12 and the OCUs 40, 44 provides operational security without the need to change plugs, keys or any other devices to link the OCUs 40, 44 with the LCU 12 for an operating session.

The typical scenario is where a first operator approaching the display screen 30 of the LCU 12, starting the process on his OCU 40, and following the display sequence. The OCU 40 will automatically begin Infra-Red (IR) communications with the IR emitter/receiver 9 of the LCU 12, make audible sounds while the data exchange is in progress, and finally, the display 49 will show when the programming is complete. Some of the data transferred is the address from each OCU 40, 44 into the LCU 12 and the transfer of the LCU 12 address to the OCU 40, 44. When the teach/learn process is completed, the two OCUs 40, 44 will have all necessary information to safely and accurately operate as a system with the LCU 12.

Part of the IR teach/learn process is to identify the primary OCU 40 and the secondary OCU 44. By identifying and programming one of the OCUs as secondary, limits are placed on the amount of data that can be transmitted by that OCU and, therefore, limits its scope of operation. In other words, the data message transmitted by the secondary OCU 44 is unique from the data message of the primary OCU 40. The data message of the secondary OCU 44 is shorter in length and does not have the command authority of the primary OCU 40.

In some cases the secondary operator may not be utilized, in which case, this step is skipped for the secondary OCU 44 resulting in primary only operation.

Initializing of the RF Communications

Once the IR teach/learn cycle has been completed, the radio remote control operation of the locomotive with LCU 12 on-board can begin. In the state where both OCUs 40, 44 are turned off, the onboard LCU 12 is in an "offline" polling mode. The LCU 12 transmits a signal, approximately once every second, in an attempt to establish a communications link with each of the portable OCUs 40, 44. This is commonly referred to as a "polling request" or "polling message".

The LCU 12 will not respond to any acknowledged messages from any OCUs other than those to which it was associated with in the IR teach/learn process.

If either the primary OCU 40 or secondary OCU 44 is turned on within radio range of the LCU 12, it will receive the polling request from the LCU 12. Each OCU 40, 44 will acknowledge the polling request within the predetermined time period assigned to each OCU during the IR teach/learn process. Such time period is known as a "time slice".

The time slices are assigned during the IR teach/learn process, whereby the OCU 40, if assigned the first time slice will always respond in the first time slice immediately following the polling message regardless of its status as either primary or secondary. In this case, the second time slice is always assigned to the OCU 44 (when two OCUs are used). Once both OCUs 40, 44 are turned on, the primary OCU 40 is capable of running all the functions onboard the locomotive, while the functionality of the secondary OCU 44 was limited internally when it was designated as the secondary OCU during the IR teach/learn process. After both OCUs 40, 44 acknowledge the polling message, the locomotive is ready for operation by the primary OCU 40.

For safety reasons, when both the primary and secondary OCUs 40, 44 have been initialized in the teach/learn process, they both must receive the polling messages from the LCU 12 and provide valid responses within five seconds in order for the system to continue operation in this mode.

The LCU 12 preferably incorporates two timers 19 and 20 which monitor the primary and secondary OCUs 40, 44, respectively. The timers 19, 20 may embody hardware or software timers and monitor when the last valid response to a polling message of the LCU 12 was received from each of the OCUs 40, 44, respectively. If a valid response has not been received from the primary OCU 40 and the secondary OCU 44 (in a two OCU setup) within the previous five seconds, the respective timer(s) 19, 20 will cause the LCU 12 to effect a full service shut down and emergency braking application in the locomotive. As described below in the Section on Dismissal and Re-joining of Secondary OCU, the present system incorporates means for activating or de-activating the timer 20 so that the secondary OCU 44 may be turned off for a period of time and then turned back on without shutting down the locomotive. In its next polling message, the LCU will also send a signal to each OCU 40, 44 which activates the beeper 65 sounding an audible alarm to warn the OCU operators of the impending locomotive shutdown. Such warning could also be a visual alarm such as a flashing light and is particularly for operators who may be riding on the locomotive or the cars it is moving to provide advance notice of the impending braking application so that they can hold on and avoid being thrown from the train.

In addition, each OCU 40, 44 also includes its own internal hardware or software timer which is reset by the "high" position of the reset bit included in each polling message from the LCU 12. This status bit attains the "1" or high state only after at least one valid response transmission has been received by the LCU 12 within the prior five seconds from each of the primary and secondary OCUs 40, 44 (in a two OCU setup). Thus, in a situation where the primary OCU 40 has transmitted valid responses to each of the last five polling messages of the LCU 12 and such responses were received by the LCU 12, the internal timer of the primary OCU 40 would not be reset where the LCU 12 had not also received at least one valid response to one of its polling messages during that same five second period. In this case, the timer 20 of the LCU 12 which monitors the secondary OCU 44 would time out and trigger the LCU 12 to initiate a full service shutdown and emergency braking application in the locomotive. At about the same time, the internal alarm timers in each of the OCUs 40, 44 would also time out since the reset status bit in each of the last four polling messages of the LCU 12 was not in the high state, since the secondary OCU 44 had not provided a valid response to any of the last five polling messages transmitted by the LCU 12. In this situation, the internal timers in each of the control units 40, 44 would initiate an alarm, such as an audible sounding of beeper 65 or a visual alarm, to warn the operators of the impending system shutdown.

The FRA safety advisory requires that the locomotive be brought to a 'STOP' if there is communications loss greater than 5 seconds. The present system satisfies this minimum requirement to solve a serious potential operational problem of remote control locomotives that occurs upon loss of communications, should this occur. The LCU 12 is programmed so that after 2.5 seconds of a communications loss, a light brake application is initiated simultaneously with elimination of tractive effort. This allows for some slack action stability. If communications are re-established between 2.5 seconds and 5 seconds, the LCU 12 resumes normal operation of the locomotive.

If the communication loss continues to full term of 5 seconds, the OCU alarm timers trigger an alarm and the LCU 12 sends the OCUs a timely audible warning that an unsolicited 'Full Service Brake Application' is about to occur. This allows operators to 'be prepared' if they are riding the side of a car. After the full term of the FRA mandated communication loss is reached and a stop is initiated, a special operator sequence is required to recover the system.

Conditions that may occur in operation of the system 10 and the corresponding messages displayed on display screen 49 of the OCUs may comprise:

(i) Communications lost to the secondary OCU 44:

OCU B will show: OCU COMM LOSS and sound the alerter tone for about 2 seconds.

(The green transmit LED 50 will have stopped responding 5 seconds prior).

Simultaneously the primary OCU 40 will show "POLL—OFFLINE"—indicating this OCU 40 is receiving and responding to a POLL but the LCU 12 is "OFF LINE"—in this case because of the communication loss between LCU and OCU 44.

(ii) Communications lost from either ONE of the OCUs to the LCU ( e.g. the secondary OCU 44):

OCU 44 and OCU 40 will both display: POLL—OFFLINE—indicating that they are receiving the LCU poll but the LCU has gone OFF LINE.

Once communication has returned, the recovery from Full service brake messages will be displayed.

In addition to receiving the acknowledgement request in the polling message, each OCU 40, 44 receives data from the LCU 12 used to control the LED indicators and text on the OCU display 49 (FIGS. 11 and 12) to show the operator(s) the presence of functional commands and the status of the onboard locomotive inputs and outputs. Each OCU 40, 44 displays the messages and switch positions of the other OCU as new control commands are transmitted. Visual displays and audible tones confirm that the action requested by the operator has been received and correctly interpreted at the locomotive. The system 10 provides this advanced capability with an effective use of two way digital technology, combined with simple two color LED indicators, audible tones and a text status display for times when the operator(s) requests more detailed information.

For example, a LED output 67 colored green on the secondary OCU 44 may be in the four (4) mph position, showing that the primary operator has selected that position and the locomotive is operating at the four (4) mph setting. This indication is shown on the secondary OCU 44, even though the speed control lever 66 thereon may be in the STOP position, as indicated by a red LED 35 (FIG. 12). The OCUs 40, 44 use the same dual-colored LEDs for the automatic brake position indicators 52, the independent brake position indicators 53, and the direction indicators 48. As shown in FIG. 12, the green LEDs 67 illuminate the settings made by the operator of the primary OCU 40 while the red LEDs 35 show the switch positions of the operator of the secondary OCU 44. The dual-colored LEDs provide a means for displaying the switch settings of both OCUs on each of the OCUs 40, 44.

A closed loop communication protocol is utilized between the OCUs 40, 44 and the LCU 12 using the same radio frequency, thus reducing voice channel clutter. This protocol does not utilize the voice communication switching frequency in use by the operators. It allows the operator to interrogate the LCU 12. The LCU 12 can advise the operator via LED and tone alerts, and a text display, of critical and non-critical status messages (FIG. 12). This capability is programmable, allowing addition or deletion of messages as determined by good operating practices.

Time-Gated Squelch

Each transceiver or receiver of each LCU 12, OCU 40 or 44, and/or repeater 80, 201 or 401 preferably employs a time-gated screening or squelch mode wherein the transceiver or receiver is masked off and only "un-masks" to listen, for a predetermined period of time (preferably 5-10 ms), for transmitted signals from within the system 10 at the precise times or very shortly after any such initial signals are expected to be received based upon the Time Division Multiplexing (TDM) or synchronized time sharing protocol employed.

Such time-gating is used to minimize the occurrences where interference and/or extraneous signals are processed (eg decoded to baseband data) by any component (LCU, OCU or repeater) of the system 10 or any subsystem 11 of the present invention. The time gating makes the system 10 more efficient and reduces occurrences of communications loss, since processing of extraneous signals or interference is minimized and thus the system 10 components are available to process signals transmitted from within the system 10 at the precise time required. The time-gated squelch protocol of the present invention is made practical, in part, through the use of the highly accurate GPS synchronized time pulse used to co-ordinate the all the transceivers (TDM) of the wireless channel employed by the system 10. Preferably, each OCU 40, 44 with its limited processing capacity compared to the other system components (LCU and repeaters) is masked off longer and wakes up just after the expected transmission has started. Thus, the OCUs 40, 44 preferably wake-up during the transmission of the message preamble which allows the transmitter sending the message to reach full strength. This protocol enables the OCUs 40, 44 to receive a clear, full-strength transmission that is less likely to be degraded by interference or a competing signal from outside the system 10. The LCUs 12 and repeaters 80, 201 or 401 which have more processing capability and can more readily recover the intended signal out of noise or other interference preferably wakes up at the precise time the message is expected to be present based upon the TDM protocol of the system 10.

For example, each repeater 80, 201 and 401 preferably is programmed to look for polling messages from LCUs 12 in the system 10 only within a predetermined period of time after the start of each successive time slot. Preferably, such predetermined period comprises the first 5-10 ms and more preferably the first 7 ms of each time slot. If the repeaters 80, 201 and 401 do not receive a transmission, or if a received transmission is not properly addressed to the repeater, it will mask it's own capability to receive and retransmit messages during the remainder of the time slot. If the repeater accepts a properly addressed transmission, it re-transmits the message and masks-off until responses are due from the OCUs 40, 44. At those time(s) within the respective time slot, the repeater's microprocesor 140 is programmed to un-mask and accept the anticipated response(s) from the associated OCUs 40, 44.

Pitch-N-Catch

The operator of the primary OCU 40 may select a point in time in which he will transfer primary control or command authority of the system to the secondary OCU 44. The operator of the primary OCU 40 does this by communicating either verbally, or through digital messages on the displays 49 of both OCUs 40, 44, the fact that he desires to transfer the primary status to the other OCU 44.

Such transfer of command authority will only occur if both the primary and secondary OCUs 40, 44 are in synchronized switch positions on both OCUs 40, 44.

For example, the OCUs 40, 44 must have their respective speed selector levers 66 in the STOP position; they must both have their respective directional selector levers 63 in neutral; and they must have their independent brake override levers 54 in "REL" or release. Here, the use of the dual-colored LEDs for the speed position indicators 46, the automatic brake position indicators 52, the independent brake position indicators 53, and the direction indicators 48 aid the operators in matching the settings on their respective OCUs 40, 44 for the purpose of transferring primary control from one OCU to the other. The use of such dual-colored LEDs allow the operators to easily spot which switches are not in matching positions on each OCU 40, 44.

When both OCUs 40, 44 are in equal positions, and the primary operator activates the pitch pushbutton 62 on OCU 40, the operator of the secondary OCU 44 then has ten seconds to accept the transfer of primary control by pushing either vigilance button 55, 64. If the transfer of primary control is successfully accepted, OCU 44 becomes the primary OCU. If the operator of OCU 44 does not accept the transfer of primary control in time, primary control reverts back to the OCU 40 and the attempted transfer of primary control fails.

There are appropriate digital messages sent from the LCU 12 to the OCUs 40, 44 indicating the fact that the LCU 12 knows that the OCU 44 is now the primary OCU and that OCU 40 is the secondary OCU. From this point forward, the operation continues as primary and secondary portable OCUs 44, 40 whereby the secondary OCU 40 will only transmit limited functions and has an abbreviated response message to the polling request as compared to that of the primary OCU 44.

Automatic Direct/Repeater Path Selection

When a repeater 80 is incorporated, each LCU 12 of the system may be programmed to automatically select the best transmission path, either direct or via the repeater 80, between the LCU 12 and the OCUs 40, 44 based upon the responses or lack of responses it receives to its polling messages from the OCUs 40, 44.

The LCU 12 is given a Start Poll highly accurate time pulse from the GPS receiver 23.

The LCU 12 then, within its given time slot, sends its polling message to both OCUs 40, 44 on the direct path. Both OCUs 40, 44 "listen" in an attempt to receive the polling message for data from the LCU 12. Each OCU that receives the polling message responds on the direct path via the single simplex radio channel. The response data word includes information used by the LCU 12 to determine on which path the responding OCU(s) transmitted their respective responses. From this information, the LCU 12 knows when either OCU has not responded via the direct radio path, and automatically transmits its next polling message via the repeater 80 (if installed as part of the system 10).

If both OCUs 40, 44 respond to the last polling message of the LCU 12 via the repeater 80 (indicated by echoing response information sent by the LCU 12), the LCU 12 continues to transmit on the repeater 80 path until communication is again lost, at which time the direct path is then tried and vice versa.

The polling message is sent by the LCU 12 to both OCUs 40, 44 at one second intervals, providing a nominal ½ second update from the operator command entry on the OCU until it is received at the LCU 12.

If either one of the OCUs 40, 44 is not within direct radio range, both will be polled by the LCU 12 on the repeater frequency. If both OCUs 40, 44 respond on either of these paths, the LCU 12 will remain on the repeater frequency until communication is next lost from either OCU 40, 44, at which time the LCU 12 will transmit its next polling message via the alternate direct radio channel.

The LCU 12 will transmit one polling message directed to both the primary and secondary OCUs 40, 44 at the same time. The LCU 12 then evaluates received messages from the OCUs 40, 44. If valid messages are received via the direct channel, the LCU 12 sends its next polling message to its associated OCUs 40, 44 via the direct channel. If the LCU 12 does not receive a valid response from either OCU 40, 44, it sends its next polling message in its given time slot to its associated OCUs 40, 44 via the repeater frequency. The LCU 12 encodes a bit in the polling message that determines the path, either direct or repeater 80, via which the OCUs 40, 44 will respond.

The LCU transmit time is calculated to be less than 30 ms.

Once the LCU 12 transmits the polling message to the OCUs 40, 44 via repeater 80, there must be allowance for the repeater 80 to come on the air. This same time is used by the OCUs 40, 44 to switch modes from receive to transmit. The time allocated for this response is preferably 10 ms.

Multiple Repeater Operation

Radio communications repeaters are preferably used to extend the operational range of the system 10 by receiving a transmission from an LCU 12 or an OCU 40, 44 on a first half duplex frequency employed by the system 10 and rebroadcasting the transmission with very minimal delay on the second half duplex transmit frequency. Repeaters have the advantage of more optimum placement in the remote control zone, and often use elevated antennae having better lines of sight to the LCUs 12 and the OCUs 40, 44. Further, the operational areas and geographic features of the railroad yard or remote control zone where the system 10 is commonly utilized often do not accommodate full radio operational coverage using just one repeater. It is often desirable to install multiple repeaters to provide the required coverage, but problems may be encountered where radio transmissions overlap from one repeater to another, or where the repeater mistakenly responds to transmissions from extraneous devices outside the system 10. Since RF coverage is not easily or accurately controlled, the system 10 of the present invention employs microprocessor-based smart repeaters to avoid interference among repeaters where multiple repeaters are required.

Figure 14:
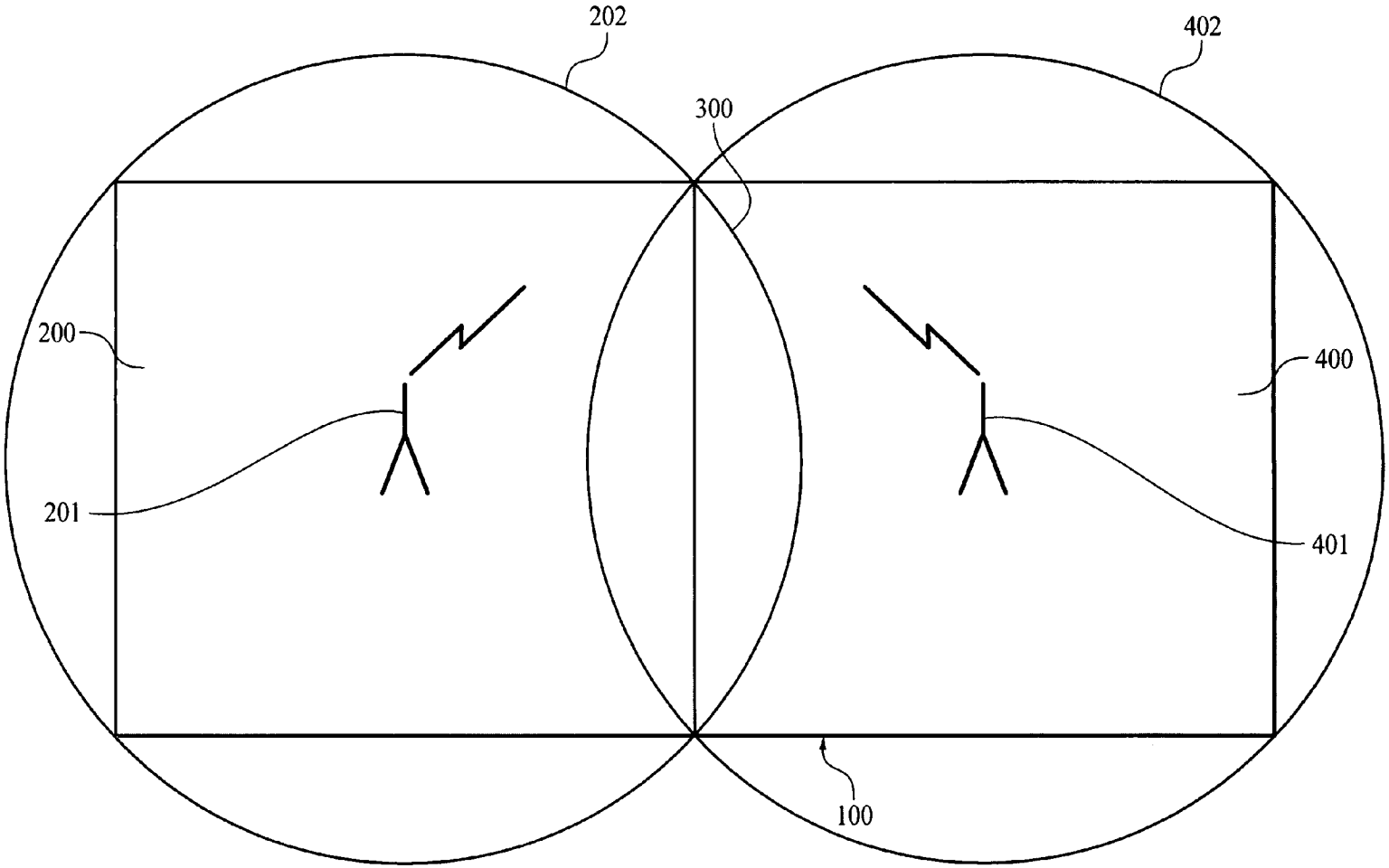
FIG. 14 is a functional block diagram of a railyard or remote control zone according to the present invention employing the repeaters of FIGS. 13A and 13B.

Operational zones for each repeater preferably are determined by technical personnel according to the operational requirements of the system 10. The zones are identified and defined by two or more latitude-longitude coordinates. These coordinates are stored in the memory of each LCU 12 in the system. Also stored in the memory of each LCU 12 are predetermined repeater address assignments for each zone the LCU 12 is to travel within. FIG. 14 shows a railyard or remote control zone 100 that has been divided into two contiguous subzones 200 and 400. Repeater 201 is located in subzone 200 and repeater 401 is located in subzone 400 on the opposite side of zone 100. The effective range of repeater 201, approximated by circle 202, extends throughout subzone 200 and into subzone 400. Likewise, the effective range of repeater 401, approximated by circle 402, extends throughout subzone 400 and into subzone 200. Thus, interference between repeaters 201 and 401 is likely to occur near the border between subzones 200 and 400 within the lens-shaped region 300 where circles 202 and 402 intersect.

Figure 13A:
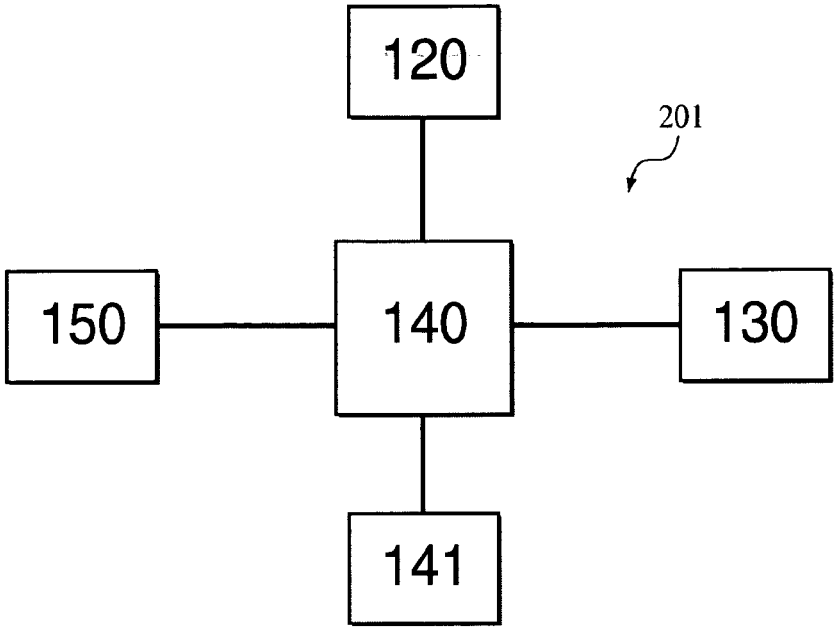
FIGS. 13A and 13B are functional block diagrams of a preferred embodiment of repeaters employed in the system of the present invention.
Figure 13B:
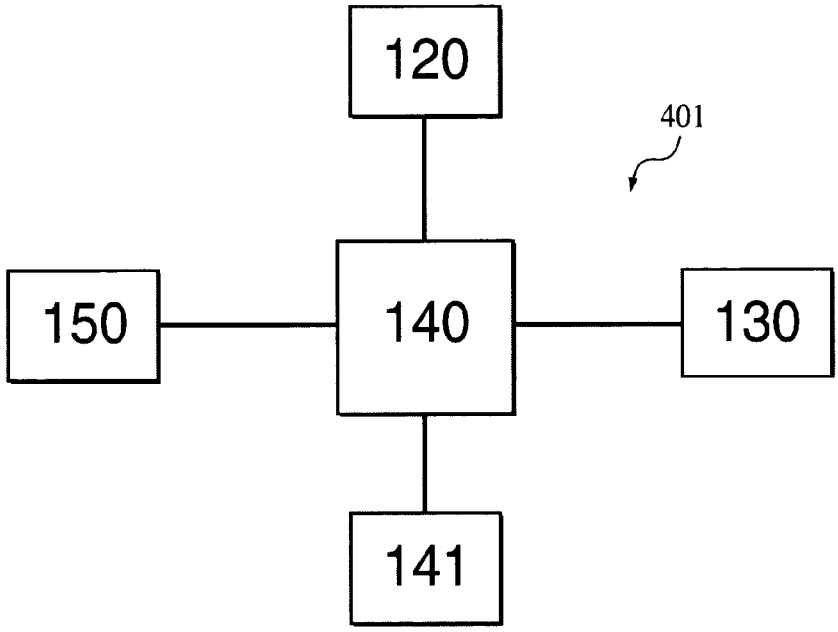

As shown in FIGS. 13A and 13B, the repeaters 201 and 401 each preferably comprise a transmitter 120, receiver 130, microprocessor 140 and a GPS receiver 150. The GPS receiver 150 may preferably be identical to the GPS receiver 23 described above and shown in FIG. 10. In addition, the microprocessor 140 of each repeater 201 and 401 is programmed with a unique address. Each repeater 201 and 401 also preferably has a memory 141 containing an address for each of the LCUs 12 and OCUs 40, 44 in the system 10 and the time slot assigned to each of the LCUs 12 and OCUs 40, 44. Each repeater preferably monitors the second half duplex channel at certain times during each of the time slots for a signal from one of the LCUs 12 or OCUs 40, 44 assigned to the respective time slot.

Referring to FIG. 14, each LCU 12 uses its GPS receiver 23 to determine its position within zone 100, that is whether it is within subzone 200 or 400 or region 300. Based upon this positional information, the LCU 12 includes the repeater address from the predetermined repeater address assignments as the repeater address to be used, if any, in the repeater address field of its next polling message. To accommodate the multiple repeaters 201 and 401, transmitted signals inbound to the repeaters preferably will have a repeater address field so that only a repeater whose address matches the address carried in the repeater address field will repeat the transmission.

The GPS receiver 150 in each repeater preferably is used to keep the repeater synchronized with the time slots employed by the system 10. Preferably, each repeater 201 and 401 is programmed to look for polling messages from LCUs in the system 10 only within a predetermined period of time after the start of each successive time slot. Preferably, such predetermined period comprises the first 5-10 ms and more preferably the first 7 ms of each time slot. If no polling message is detected by a repeater within this predetermined time period, the repeater will go quiet and not re-transmit any message it receives regardless of whether such polling message contains a matching address for the repeater. This procedure provides additional protection against the repeater falsely identifying transmissions from sources outside the system 10 as coming from the LCUs or OCUs of the system 10. Thus, interference from outside sources is also reduced in the system 10 of the present invention.

The microprocessor 140 of each repeater preferably is programmed to repeat a polling message or other transmission it receives from an LCU 12 only if a bit header in the transmission contains an address identical to the repeater's address. The delay in retransmission of a signal by a repeater is necessary for the repeater to read a repeater address field in the message header to determines whether the repeater is addressed, and should repeat the message. Once the repeater accepts the transmission addressed to it and re-transmits the message, the repeater masks-off and its microprocesor 140 is programmed to un-mask and accept the anticipated response from the associated OCUs 40, 44 at the correct time within the respective time slot. The LCU 12 encodes a bit in the polling message that determines the path, either direct or repeater, via which the OCUs 40, 44 will respond. OCUs 40, 44 associated with a particular LCU 12 will see this address in the repeated LCU message, and transmit their responses via the repeater path. In a subsystem employing two OCUs, the addressed repeater un-masks at one or two time slices (based on the number of OCUs in use) at the appropriate times within the given time slot to receive the responses from the OCUs 40,44. Any other repeater(s) in the system 10 not addressed preferably will be masked off for the duration of the time slot and will not respond to any transmissions until the beginning of the next time slot. At that time, each repeater again looks for a polling message addressed to it.

Thus, in the multiple repeater system 10 of the present invention, preferably only one repeater will be active during any given time slot and the addressable nature of the repeaters 201 and 401 virtually eliminates the interference between multiple repeaters with overlapping coverage.

Dismissal and Re-joining of Secondary OCU

Locomotive operations may be started in the two operator mode, but at certain times the job requirements of the operator of the secondary OCU 44 may require him to leave the immediate area, potentially going beyond radio operating range of the system 10. When this need arises, it is desirable to have a positive way for the operator of the primary OCU 40 to dismiss the secondary OCU 44, and also to allow the secondary OCU 44 to re-join the operation without requiring a shutdown of the system 10, with the permission of the primary operator.

When the operator of the secondary OCU 44 wants to be dismissed, he presses both VIGILANCE buttons 55, 64 for three or more seconds. A message "SECONDARY OCU REQUEST DISMISSAL" is then displayed on the screens 49 of both OCUs 40, 44.

If the operator of the primary OCU 40 acknowledges this request within 20 seconds by pressing both vigilance buttons 55, 64 for three or more seconds, a message "SECONDARY OCU DISMISSED" is displayed on the screens 49 of both OCUs 40, 44 for 30 seconds during which the operator of the secondary OCU 44 must power off his OCU 44 by using switch 61. If the secondary OCU 44 is not turned off, and is still communicating after 30 seconds, the dismissal is aborted and both OCUs 40, 44 remain in their respective control roles.

When the secondary operator desires to return to operation, he must power on OCU 44 and notify his intentions to the primary operator by voice radio. The operator of the primary OCU 40 must press both VIGILANCE buttons 55, 64 on the primary OCU 40 for five or more seconds.

After the five second period has elapsed, and the vigilance buttons 55, 64 on the primary OCU 40 are released, the primary and secondary OCUs 40, 44 will return to normal dual control with full display capabilities. In addition, returning to normal dual control mode requires the same start-up procedure as is initially performed when the OCUs 40, 44 are first turned on. Such start-up procedure requires that the secondary OCU 44 recovers from a full service brake application by moving his automatic brake override selector 54 to the FULL position; pressing either vigilance button 55, 64 and then moving his automatic brake override selector 54 to the RELEASE position. The primary OCU 40 must then also recover from a full service brake application by moving his automatic brake override selector 54 to the FULL position; pressing either vigilance button 55, 64 and then moving his automatic brake override selector 54 to the RELEASE position. After this procedure has been completed, the operator of the primary OCU 40 will have control of the locomotive, and the operator of the secondary OCU 44 will have full protection of the system 10 and limited control.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described herein above is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A system for remotely controlling a plurality of locomotives via first and second half duplex wireless channels comprising:

a plurality of controllers, one for installation on-board of each of the locomotives, wherein each controller comprises a transmitter, a receiver a GPS receiver and a timing means, and wherein each of said plurality of controller periodically receives coordinates of the geographic position of its respective locomotive from its respective GPS receiver, a plurality of control units, each comprising a transmitter and a receiver, wherein each of said control units is associated with one of said controllers for transmitting and receiving signals for controlling one of said locomotives, wherein each timing means is synchronized by a common source and wherein each controller is assigned a time slot for sending a polling message to said associated control unit and receiving a responsive transmission therefrom;

a plurality of repeaters, wherein each of said plurality of repeaters has an address code and comprises a transmitter, a receiver, and a microprocessor, wherein each of said repeaters receives a signal from one of said controllers and control units on said second half duplex wireless channel; and wherein each of said controllers uses said coordinates as a basis for choosing the address code of one of said plurality of repeaters to include in its polling signal to be sent over said second half duplex wireless channel.

2. The system of claim 1 wherein each of said repeaters only re-transmits a received signal containing its address code.

3. The system of claim 1 wherein said microprocessor of each repeater reads a portion of each signal received to determine whether said signal contains its address code.

4. The system of claim 3 wherein each of said repeaters only re-transmits a received signal containing its address code.

5. The system of claim 1 wherein each of said repeaters further comprises a timing means and a GPS receiver.

6. The system of claim 5 wherein each of said repeaters employs a signal from said GPS receiver to synchronize its timing means and monitors its time slots on said second half duplex channel.

7. The system of claim 6 wherein each of said repeaters has a memory containing an address for each of said plurality of controllers and control units and the time slot assigned to each of said controllers and control units and wherein said repeater monitors each of said repeaters second half duplex channel during each of said time slots for a signal from the controller or control unit assigned to the respective time slot.

8. The system of claim 6 wherein each of said repeaters monitors said second half duplex channel for a predetermined period of time during each of said time slots.

9. The system of claim 8 wherein said predetermined period of time equals about seven milliseconds.

10. The system of claim 6 wherein each of said repeaters monitors said second half duplex channel at the beginning of each of said time slots for a predetermined period of time.

11. The system of claim 10 wherein each of said repeaters upon not receiving a signal containing its address code, masks off until the beginning of the next successive time slot, when it unmasks to monitor said second half duplex channel.

12. The system of claim 10 wherein said predetermined period of time equals about seven milliseconds.

13. The system of claim 10 wherein each of said repeaters upon receiving a signal containing its address code, re-transmits said signal on said first half duplex channel.

14. The system of claim 13 wherein each of said repeaters masks off after making said re-transmission and unmasks at a later time within a time slot to monitor said second half duplex channel.

15. The system of claim 1 wherein each of said control units monitors said first half duplex channel at the beginning of its respective time slot for a predetermined period of time.

16. The system of claim 15 wherein each of said control units, upon receiving a signal from its respective controller, transmits a response to said signal.

17. The system of claim 16 wherein each of said control units masks off after making said responsive transmission and unmasks at the beginning of its next respective time slot.

18. The system of claim 16 wherein each of said control units masks off after making said responsive transmission and unmasks just after the beginning of its next respective time slot.

19. The system of claim 1 wherein each of said controllers is masked off during the time slots assigned the other controllers in the system.

20. A system for remotely controlling a plurality of locomotives within a geographic zone via first and second half duplex wireless channels comprising:

a plurality of controllers each comprising a transmitter, a receiver, a memory containing coordinates of said geographic zone and a plurality of sub-zones within said geographic zone, wherein each of said controllers is for installation on one of said locomotives;

a GPS receiver operably connected to each controller, wherein each of said plurality of controllers periodically receives coordinates of the geographic position of its respective locomotive from its respective GPS receiver;

a plurality of control units each comprising a transmitter and a receiver, wherein each of said control units is associated with one of said controllers for transmitting signals thereto and receiving signals therefrom;

a plurality of repeaters located within said geographic zone, wherein each of said repeaters has an address code and comprises a transmitter, a receiver, a microprocessor wherein each of said repeaters is capable of receiving signals from said controllers and control units on said second half duplex wireless channel but only re-transmits on said first half duplex wireless channel those signals containing its respective address code, and wherein each of said controllers uses said coordinates as a basis for choosing the address code of one of said plurality of repeaters to include in its polling signal to be sent over said second half duplex wireless channel.

21. The system of claim 20 wherein each of said repeaters is located in a different sub-zone.

22. The system of claim 20 wherein each of said plurality of controllers uses said coordinates to determine the location of its respective locomotive within said plurality of sub-zones.

23. The system of claim 20 wherein each controller is assigned a time slot for sending a polling signal to its associated control unit and receiving a responsive transmission therefrom.

24. The system of claim 23 wherein each repeater further comprises a timing means and a GPS receiver.

25. The system of claim 24 wherein each repeater employs a signal from its respective GPS receiver to synchronize its timing means and monitors said second half duplex channel during each of said time slots.

26. The system of claim 25 wherein each repeater monitors said second half duplex channel for a predetermined period of time during each of said time slots.

27. The system of claim 26 wherein said predetermined period of time equals about seven milliseconds.

28. The system of claim 25 wherein each repeater monitors said second half duplex channel at the beginning of each of said time slots for a predetermined period of time for a signal from one of said controllers.

29. The system of claim 28 wherein said predetermined period of time equals about seven milliseconds.

30. The system of claim 25 wherein one of said repeaters which has retransmitted a properly addressed signal from a first of said controllers within a first time slot monitors said second half duplex channel for a predetermined period of time during a remainder of said first time slot for a responsive signal from the control unit associated with said first controller.

31. The system of claim 30 wherein the other repeaters mask off during said first time slot.

32. The system of claim 23 wherein each repeater has a memory containing an address for each of said plurality of controllers, an address for each of said control units and the time slot assignments for each of said controllers and control units.

33. A system for remotely controlling a plurality of locomotives within a geographic zone via first and second half duplex wireless channels comprising:

a plurality of subsystems each comprising:

a controller, for mounting on-board said locomotive, comprising a transmitter, a receiver, GPS receiver and a timing means, wherein said controller periodically receives coordinates of the geographic position of its respective locomotive from its GPS receiver;

a control unit comprising a receiver and a transmitter associated with said controller for receiving a polling signal from said controller and for transmitting a responsive signal containing operating commands to said controller;

wherein said timing means is synchronized by a common clock and wherein said controller is assigned a time slot for sending said polling signal to its associated control unit receiving said responsive signal; and a plurality of repeaters wherein each repeater has a unique address and receives signals from said controllers and control units on said second half duplex wireless channel and wherein each of said controller uses said coordinates as a basis for choosing the address code of one of said plurality of repeaters to include in its polling signal to be sent over said second half duplex wireless channel.

34. The system of claim 33 wherein each of said repeaters only re-transmits on said first half duplex wireless channel those received signals containing its respective address.

35. The system of claim 33 wherein each of said controllers further comprises a memory containing coordinates of said geographic zone and a plurality of sub-zones within said geographic zone.

36. The system of claim 35 wherein each repeater is located in a different sub-zone.

37. The system of claim 35 wherein the controller of each subsystem uses said coordinates to make a determination of the location of its respective locomotive within said plurality of sub-zones.

38. The system of claim 37 wherein the controller of each subsystem selects the address code of one of said plurality of repeaters to include in its next polling signal to be sent over said second half duplex wireless channel on the basis of said determination.

39. The system of claim 33 wherein each repeater further comprises a timing means and a GPS receiver.

40. The system of claim 39 wherein each repeater employs a signal from its respective GPS receiver to synchronize its timing means.

41. The system of claim 40 wherein each repeater monitors said second half duplex channel during each of said time slots.

42. The system of claim 40 wherein each repeater monitors said second half duplex channel for a predetermined period of time during each of said time slots.

43. The system of claim 42 wherein said predetermined period of time equals about seven milliseconds.

44. The system of claim 40 wherein each repeater monitors said second half duplex channel at the beginning of each of said time slots for a predetermined period of time for a signal from one of said controllers.

45. The system of claim 44 wherein said predetermined period of time equals about seven milliseconds.

46. The system of claim 40 wherein one of said repeaters which has retransmitted a properly addressed signal from a first of said controllers within a first time slot monitors said second half duplex channel for a predetermined period of time during a remainder of said first time slot for a responsive signal from the control unit associated with said first controller.

47. The system of claim 33 wherein each repeater has a memory containing an address for each of said plurality of controllers, an address for each of said control units and the time slot assignments for each of said controllers and control units.

48. The system of claim 33 wherein said common clock is carried on a satellite which transmits a signal to synchronize said timing means of each controller.

49. The system of claim 33 wherein each controller transmits said polling message to its associated control units once every second and each time slot has a duration of one tenth of a second.

50. The system of claim 33 wherein each subsystem further comprises a second control unit comprising a receiver and a transmitter associated with said controller.

51. The system of claim 50 wherein an initial polling message is sent by each controller directly to its associated first and second control units over said first half duplex wireless channel.

52. The system of claim 50 wherein each controller transmits said polling message, and its associated first and second control units respond thereto, over said first half duplex wireless channel so long as said controller receives a responsive transmission from each of its associated control units.

53. The system of claim 50 wherein each controller, upon not receiving a responsive transmission to its last polling signal from either of its associated control units over said first half duplex wireless channel within said time slot, transmits a subsequent polling signal containing the address code of one of said repeaters over said second half duplex wireless channel wherein said subsequent polling signal contains a bit instruction instructing each associated control unit to transmit a response over said second half duplex wireless channel.

* * * * *